US010364568B2

(12) United States Patent
Kramer

(10) Patent No.: US 10,364,568 B2
(45) Date of Patent: Jul. 30, 2019

(54) FABRICATED BUILDING

(71) Applicant: Richard Kramer, Bowling Green, OH (US)

(72) Inventor: Richard Kramer, Bowling Green, OH (US)

( * ) Notice: Subject to any disclaimer, the term of this patent is extended or adjusted under 35 U.S.C. 154(b) by 5 days.

(21) Appl. No.: 15/545,828

(22) PCT Filed: Jan. 25, 2016

(86) PCT No.: PCT/US2016/014734
§ 371 (c)(1),
(2) Date: Jul. 24, 2017

(87) PCT Pub. No.: WO2016/118953
PCT Pub. Date: Jul. 28, 2016

(65) Prior Publication Data

US 2018/0023292 A1 Jan. 25, 2018

Related U.S. Application Data

(60) Provisional application No. 62/106,895, filed on Jan. 23, 2015.

(51) Int. Cl.
*E04B 2/16* (2006.01)
*E04B 7/02* (2006.01)
(Continued)

(52) U.S. Cl.
CPC ..... *E04B 2/16* (2013.01); *E04B 1/34326* (2013.01); *E04B 2/56* (2013.01); *E04B 7/022* (2013.01);
(Continued)

(58) Field of Classification Search
CPC . E04D 13/158; E04B 7/14; E04B 2/16; E04H 1/1205; E04H 15/008; Y02A 40/252
See application file for complete search history.

(56) References Cited

U.S. PATENT DOCUMENTS 2,047,721 A * 7/1936 Wilson ..... E04B 1/10 52/63
2,309,426 A 1/1943 Williams
(Continued)

FOREIGN PATENT DOCUMENTS

WO 2006120353 A2 11/2006

*Primary Examiner* — Brian E Glessner
*Assistant Examiner* — Adam G Barlow
(74) *Attorney, Agent, or Firm* — MacMillan, Sobanski & Todd, LLC

(57) ABSTRACT

A fabricated building includes a plurality of vertically extending guide members and a plurality of building blocks arranged with the aid of said guide members to define a wall structure. Each block has a first end provided with a vertically extending guide hole having one of the guide members extending therethrough, and a second end coupled to a first end of a horizontally adjacent block. The fabricated building also includes a first threshold defining a first guide hole having one of the guide members extending therethrough and a second guide hole having one of the guide members extending therethrough. The fabricated building also includes a second threshold defining a first guide hole having one of the guide members extending therethrough and a second guide hole having one of the guide members extending therethrough. The first threshold and the second threshold define a frame space therebetween.

15 Claims, 23 Drawing Sheets

(51) Int. Cl.

| | |
|---|---|
| ***E04B 7/14*** | (2006.01) |
| ***E04D 5/06*** | (2006.01) |
| ***E04H 1/12*** | (2006.01) |
| ***E04B 1/343*** | (2006.01) |
| ***E04B 2/56*** | (2006.01) |
| ***E04D 5/14*** | (2006.01) |
| ***E04D 13/158*** | (2006.01) |
| ***E04H 1/02*** | (2006.01) |
| *E04B 2/02* | (2006.01) |

(52) U.S. Cl.

CPC ..... *E04B 7/14* (2013.01); *E04D 5/06* (2013.01); *E04D 5/144* (2013.01); *E04D 13/158* (2013.01); *E04H 1/02* (2013.01); *E04H 1/1205* (2013.01); *E04B 2002/0243* (2013.01)

(56) References Cited

U.S. PATENT DOCUMENTS 2,476,229 A 7/1949 Tobin
2,765,498 A * 10/1956 Kelnhofer ..... E04B 1/3445 52/63
2,883,712 A 4/1959 Shelamer
3,103,083 A * 9/1963 Seeger ..... A01F 25/16 135/115
3,264,021 A 8/1966 Artman
3,295,264 A * 1/1967 Olson ..... E04D 13/076 160/349.1
3,355,745 A * 12/1967 Jannuzzi ..... E04H 4/106 211/180
3,375,831 A * 4/1968 Serbus ..... E04H 15/34 135/115
3,404,495 A * 10/1968 Simpson, Jr. ..... E04D 13/15 52/273
3,464,168 A 9/1969 Russell
3,511,000 A 5/1970 Keuls
3,585,766 A * 6/1971 Jamieson ..... E04D 13/155 52/60
3,777,425 A * 12/1973 Le Bourgeois ..... A01G 9/1407 52/2.23
3,798,852 A 3/1974 Nicoll
3,883,999 A 5/1975 Nicoll
4,034,527 A 7/1977 Jalasjaa
4,074,476 A 2/1978 Ordorika
4,241,549 A * 12/1980 Hall, III ..... E04D 13/155 52/60
4,531,564 A 7/1985 Hanna
4,608,799 A 9/1986 Hasegawa
4,694,543 A * 9/1987 Conley ..... F16B 5/0692 160/395
4,706,420 A * 11/1987 Winkler ..... A01G 9/22 52/66
4,726,153 A * 2/1988 Adler ..... E04H 15/34 135/88.13
4,800,689 A * 1/1989 Lane ..... E04D 13/155 52/60
4,823,528 A 4/1989 Faw
4,901,484 A * 2/1990 Santosuosso ..... E04H 3/16 52/63
5,125,867 A 6/1992 Solomon
5,140,788 A * 8/1992 Lynch ..... A01G 9/1407 454/364
5,226,276 A 7/1993 Cahill
D338,140 S 8/1993 Scott
5,251,411 A * 10/1993 Kelley ..... E04D 13/064 156/290
5,259,158 A * 11/1993 Levy ..... E04B 7/163 52/63
D343,509 S 1/1994 Scott
5,319,896 A 6/1994 Winger
5,333,425 A * 8/1994 Nickerson ..... E04H 15/18 160/383
5,406,764 A * 4/1995 Van Auken ..... E04D 12/00 52/408
5,410,844 A * 5/1995 Lynch ..... A01G 9/1407 52/63
5,881,515 A 3/1999 George
5,984,589 A 11/1999 Ciccarello
6,134,848 A * 10/2000 Walter ..... E04B 7/105 52/222
6,260,308 B1 * 7/2001 Looney ..... A01G 9/227 52/63
6,295,778 B1 10/2001 Burt
6,684,584 B1 * 2/2004 Goldwitz ..... E04H 15/646 135/143
6,766,619 B1 7/2004 Franz
6,786,015 B2 9/2004 Wilt
6,843,019 B2 * 1/2005 Mercurio ..... A01G 9/242 47/17
6,845,590 B1 * 1/2005 Mills, Jr. ..... E04D 13/155 52/60
6,904,720 B1 * 6/2005 Adolfson ..... E04F 13/002 160/368.1
7,596,916 B1 10/2009 Anderson
7,610,729 B1 * 11/2009 Ayers, Jr. ..... E04D 13/152 454/260
7,735,502 B1 * 6/2010 Hotes ..... E04H 15/36 135/136
7,779,579 B2 8/2010 Mower
7,810,277 B2 10/2010 Fakhari
8,490,336 B2 * 7/2013 Nark ..... H05B 3/06 219/213
8,549,794 B2 * 10/2013 Hotes ..... E04H 15/16 135/156
8,782,960 B2 * 7/2014 Nark ..... H05B 3/06 52/13
9,428,926 B2 8/2016 Kramer
2004/0187411 A1 9/2004 Clegg
2006/0000179 A1 1/2006 Albert
2007/0130873 A1 6/2007 Fisher
2007/0245673 A1 10/2007 Cerrato
2007/0251182 A1 11/2007 Van Steinburg
2008/0263968 A1 10/2008 Day
2009/0044461 A1 2/2009 Diamond
2009/0106102 A1 4/2009 Johnson
2009/0133345 A1 5/2009 Wrightman
2009/0188196 A1 7/2009 MacDonald
2010/0088970 A1 4/2010 Miller
2010/0319285 A1 12/2010 Jewett
2010/0325971 A1 12/2010 Leahy
2011/0023402 A1 2/2011 Fisher
2011/0162318 A1 7/2011 Bucheger

* cited by examiner

FABRICATED BUILDING

CROSS-REFERENCE TO RELATED APPLICATIONS

This application claims the benefit of U.S. Provisional Application No. 62/106,895, filed Jan. 23, 2015, the disclosure of which is incorporated herein by reference. This application claims the benefit of Application No. WO 2012 012455, filed Jul. 19, 2011, the disclosure of which is incorporated herein by reference.

BACKGROUND OF THE INVENTION

This invention relates to a kit fabricated housing structure. More specifically, this invention relates to improvements to a kit fabricated building.

There are situations in which it is desirable to construct temporary or permanent housing, but conventional building materials are not readily available. Events such as natural disasters can displace a population and destroy existing housing, while some locations may be isolated from normal sources of construction materials, increasing the expense of housing. In some situations, it may be expected that housing structures constructed in a particular location will only be temporarily used. This may be because the people are expected to move to a new location in a relatively short period of time, or because the housing is constructed in a location where it is highly susceptible to damage or destruction. In these cases it is typically desirable to reduce the cost invested in the housing, in particular because those costs may have to be reinvested when the housing is moved or rebuilt.

In situations where temporary housing or housing made from non-conventional building materials are constructed, it is typical to use structures such as tents. These are lightweight, relatively inexpensive, and easy to erect and disassemble. However, these structures typically lack the insulation and privacy provided by structures made of conventional building materials. It is desirable to be able to construct housing that provides privacy at a reduced cost compared to traditional building materials.

SUMMARY OF THE INVENTION

This invention relates to a fabricated building. The fabricated building includes a plurality of vertically extending guide members arranged in a horizontally spaced apart relationship corresponding to a desired wall structure. A plurality of building blocks are arranged in an interconnected and stacked relationship with the aid of said guide members to define the wall structure. Each block has a first end provided with a vertically extending guide hole having one of the guide members extending therethrough, and a second end coupled to a first end of a horizontally adjacent block. The fabricated building also includes a first threshold defining a first guide hole having one of the guide members extending therethrough and a second guide hole having one of the guide members extending therethrough. The fabricated building also includes a second threshold defining a first guide hole having one of the guide members extending therethrough and a second guide hole having one of the guide members extending therethrough. The first threshold and the second threshold define a frame space therebetween.

This invention also relates to a fabricated building having a roof and a soffit member extending from the wall structure.

The soffit member includes a retainer end that is engaged with an inner end of the roof.

This invention also relates to a fabricated building including a wall structure defining an interior side and an exterior side and a roof frame supported on the wall structure. A roof skirt is supported by the wall structure and includes a skirt tongue that is located on the exterior side of the wall structure. A roll up roof is supported by the roof frame and includes a roof tongue that is located on the exterior side of the wall structure. A roof lock is formed from the skirt tongue folded with the roof tongue.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
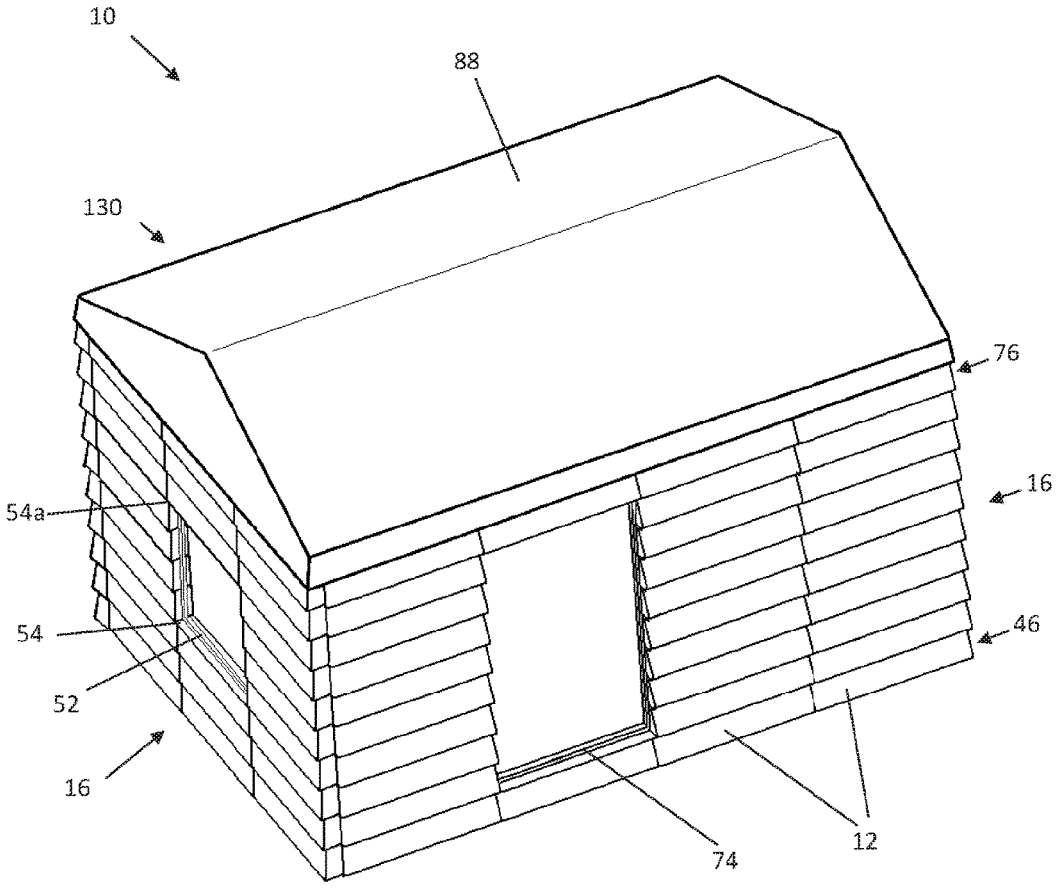
FIG. 1 is a perspective view of a fabricated building.

Referring now to the drawings, there is illustrated in FIG. 1 a fabricated building, indicated generally at 10. The illustrated fabricated building 10 is similar to the prefabricated building described in PCT Patent Application WO 2012 012455, the disclosure of which is incorporated by reference herein.

The illustrated fabricated building 10 includes a plurality of structural members 12. The illustrated structural members 12 are made from sheets of corrugated polypropylene sheet material that are folded into the illustrated shape. However, the structural members 12 may be made of other desired materials. The structural members 12 are arranged on a plurality of hollow guide poles 14 (shown in FIG. 6) to create walls 16. The fabricated building 10 is assembled in a manner similar to the prefabricated building described in PCT Patent Application WO 2012 012455. However, it should be appreciated that the fabricated building 10 may be assembled in a different manner, if desired.

Figure 2:
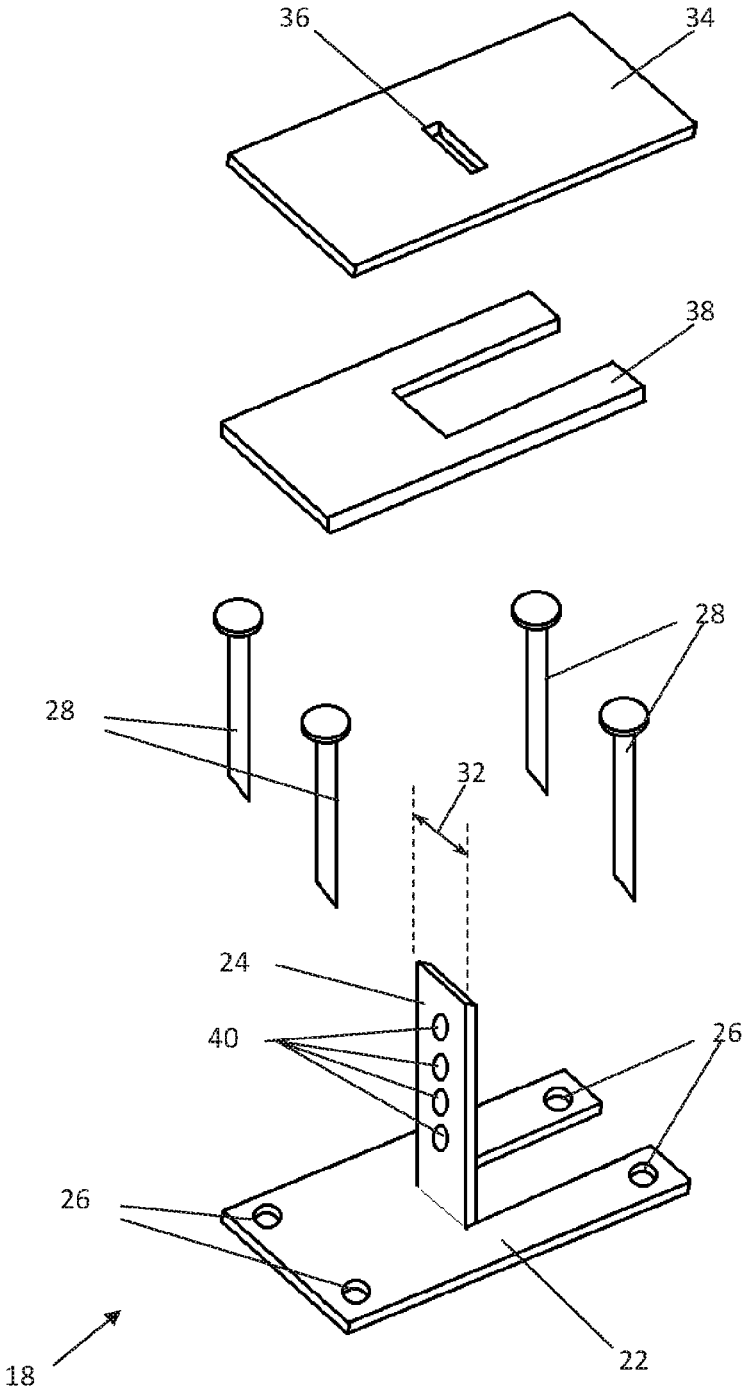
FIG. 2 is a perspective view of a mounting plate used in the assembly of the fabricated building of FIG. 1 to anchor the fabricated building to a ground surface.
Figure 6:
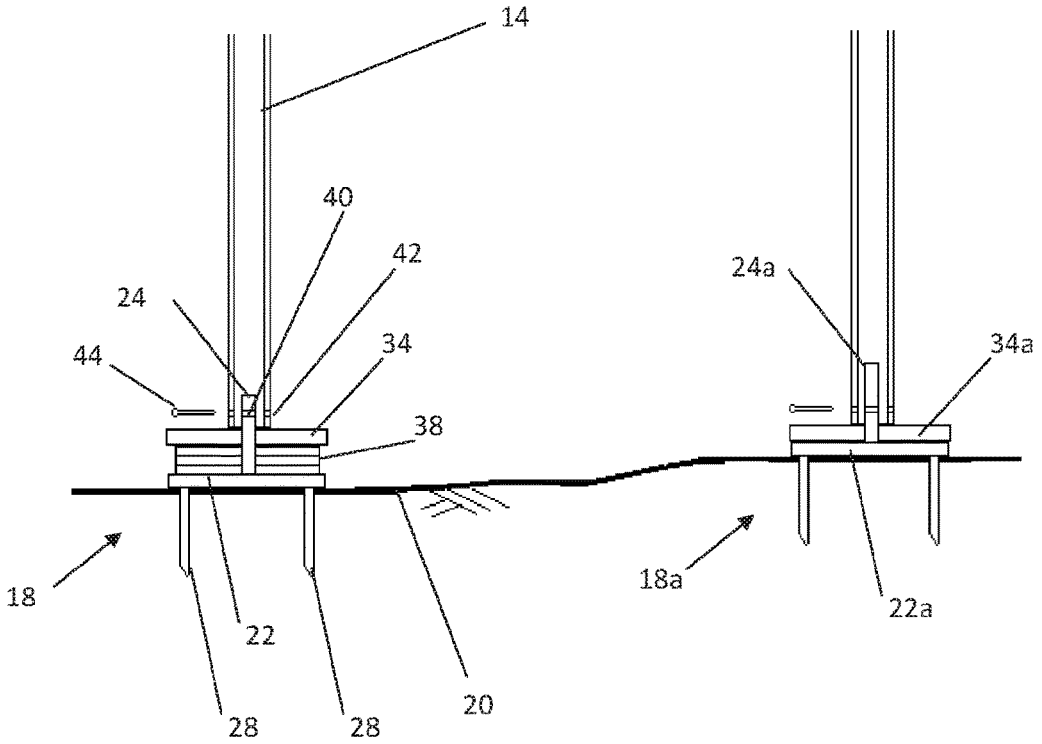
FIG. 6 is a cross-sectional view of two mounting plates attached to the ground surface.

Referring to FIG. 2, a perspective view of a mount plate, indicated at 18, is shown. The illustrated mount plate 18 is made of plastic, but may be made of any desired material. The mount plate 18 serves to anchor the guide poles 14 relative to a ground surface 20, as shown in FIG. 6. The mount plate 18 includes a base 22 and an extension 24. The illustrated base 22 is flat and during assembly of the fabricated building 10 is placed on the ground surface 20. The base 22 defines a plurality of base holes 26 and ground anchors 28 are driven through the base holes 26 in order to stabilize the mount plate 18 relative to the ground surface 20. It should be appreciated that the illustrated fabricated building 10 includes a mount plate similar to the illustrated mount plate 18 for each guide pole 14. For example, a second mount plate 18*a* is shown in FIG. 6. The illustrated extension 24 is made of the same plastic as the base 22 and extends perpendicularly from the base 22. However, the extension 24 may be made of a different material from the base 22, if desired. The extension 24 has a width 32 that allows the hollow guide pole 14 to be placed over the extension 24. The illustrated width 32 is sized to correspond to the internal diagonal width of the guide pole 14. However, the extension 24 and the guide pole 14 may have any desired relative sizes.

Depending on the location where the fabricated building 10 is being constructed, the ground surface 20 may not be level and the mount plates 18 and 18*a* may be at different elevations. It may be desirable for the walls 16 of the fabricated building 10 to be level and an optional base platform 34 may be installed to help adjust the position of the guide pole 14. Referring to FIG. 2, the base platform 34 defines a platform slot 36 that allows the base platform 34 to be placed over the extension 24 and be moved along the extension 24 relative to the ground surface 20. One or more shims 38 may be inserted between the base 22 and the base platform 34 in order to support the base platform 34 at a desired distance from the ground surface 20. The illustrated shims 38 are made of 5 millimeter thick corrugated polypropylene, but the shims 38 may be made of any desired material. As shown in FIG. 6, the mount plate 18 and the mount plate 18*a* may have a different number of shims 38 installed in order to keep the respective base platforms 34 and 34*a* at the desired heights relative to the ground surface 20.

The extension 24 defines a plurality of extension holes 40 and the guide pole 14 defines a lower pole hole 42 that extends through two sides of the guide pole 14. A lower fastener 44 is inserted through the lower pole hole 42 and one of the extension holes 40 in order to anchor the guide pole 14 relative to the mount plate 18. The illustrated lower fastener 44 is a steel split pin, but any desired fastener may be used.

Figure 3:
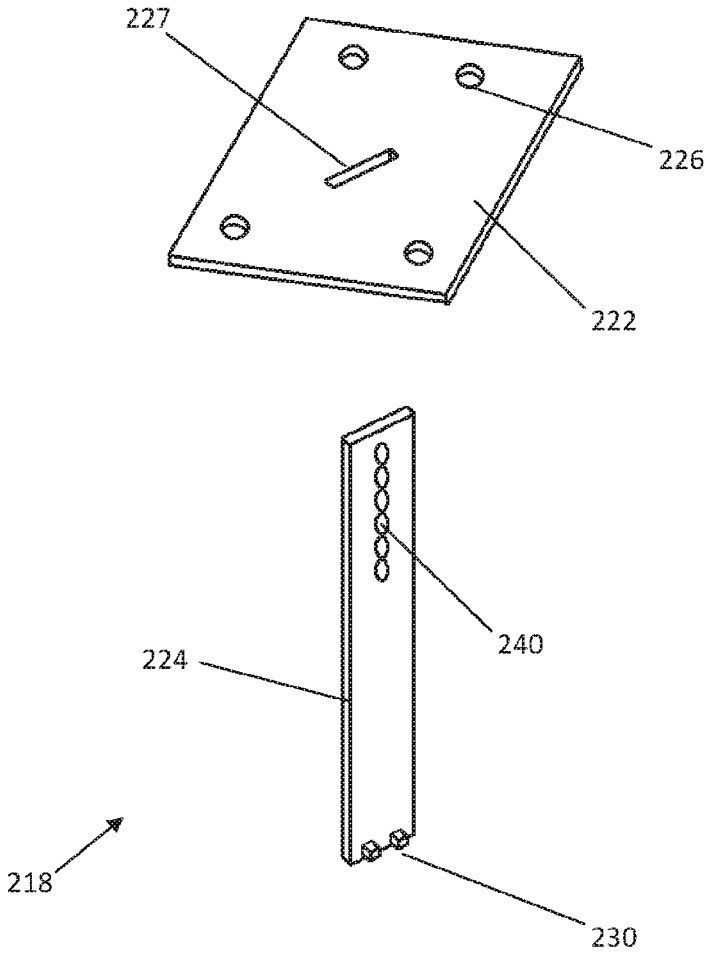
FIG. 3 is a perspective view of an alternative mounting plate that is comprised of two separate pieces.
Figure 4:
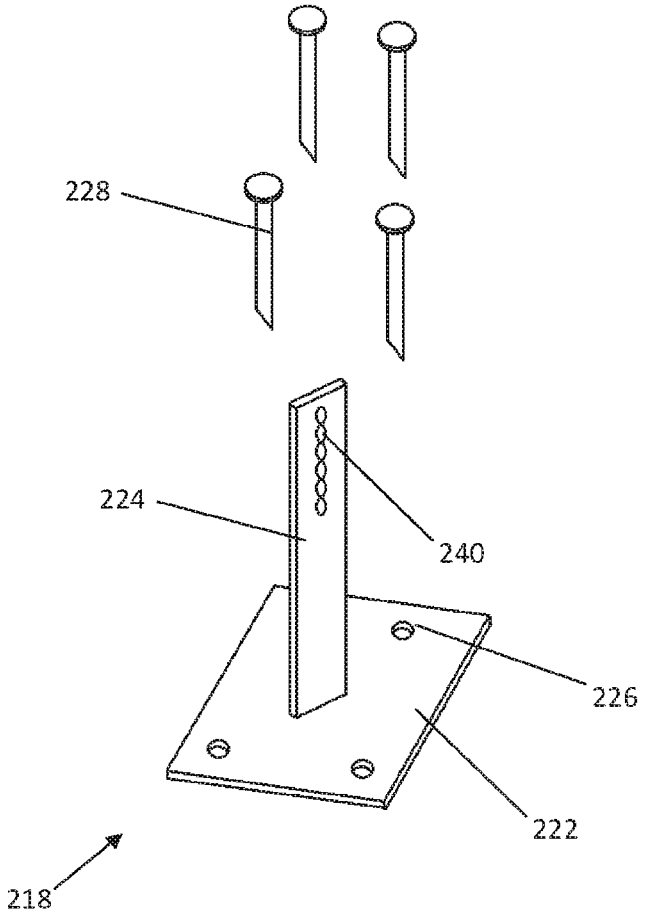
FIG. 4 is a perspective view of the alternative mounting plate of FIG. 3, showing the two pieces assembled together.

Referring to FIG. 3, an alternative mount plate 218 is shown. The alternative mount plate 218 includes a base 222 and a separate extension 224. The illustrated base 222 and extension 224 are made of corrugated polypropylene, but may be made of any desired materials. The base 222 defines a base slot 227, which is sized so that the extension 224 may be inserted longitudinally into the base slot 227. The extension 224 includes a protrusion 230 that is larger than the base slot 227 and is adapted to engage the base 222. The illustrated protrusion 230 is a pair of metal tacks extending through the extension 224, but the protrusion 230 may be any desired material. To use the alternative mount plate 218, the extension 224 is inserted into the base slot 227 and the extension 224 is moved relative to the base 222 until the protrusion 230 engages the base 222. The alternative mount plate 218 is then in the configuration shown in FIG. 4, and ground anchors 228 are driven through base holes 226. The extension 224 defines a plurality of extension holes 240 that are used to anchor the guide pole 14 similarly to as previously described in reference to mount plate 18.

Figure 5:
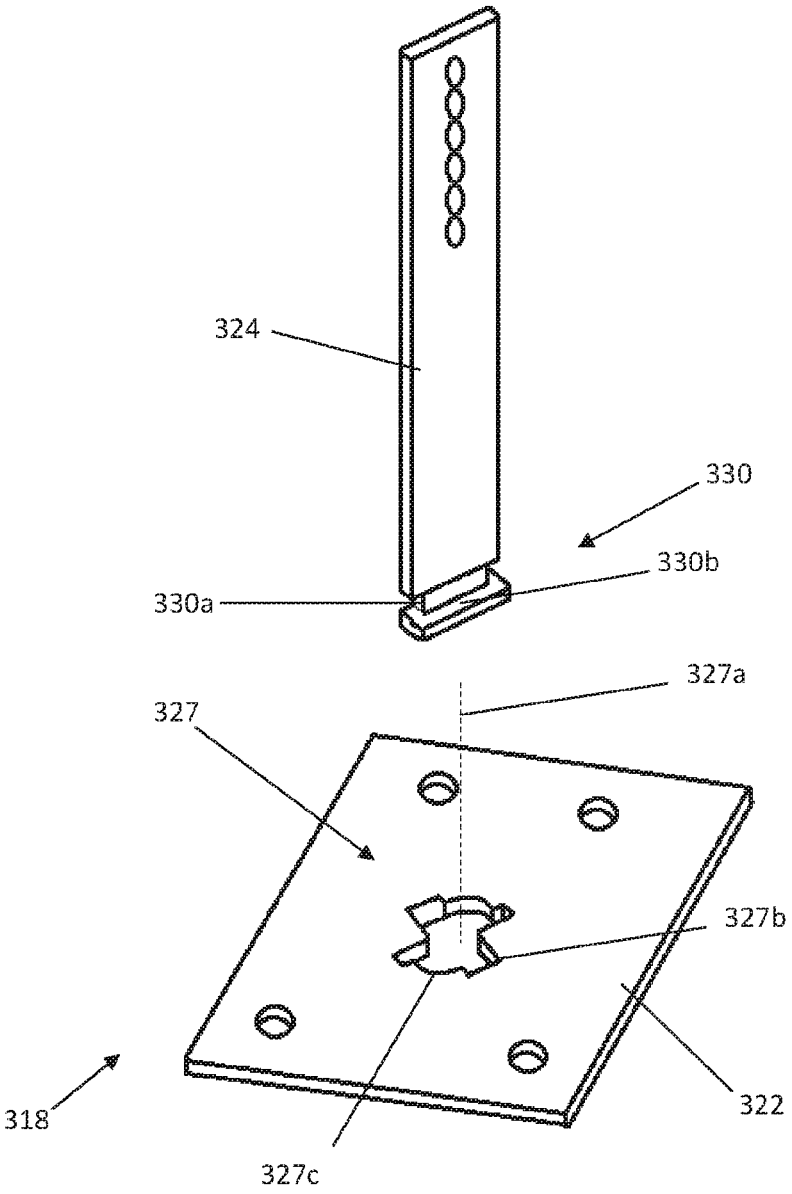
FIG. 5 is a perspective view of a second alternative mounting plate that is comprised of two pieces with a key and lock connector.

Referring to FIG. 5, a second alternative mount plate 318 is shown. The second alternative mount plate includes a base 322 and a separate extension 324. The illustrated base 322 and extension 324 are made of HDPE plastic, but may be made of any desired materials. The base 322 defines a lock, indicated generally at 327, while the extension 324 includes a key, indicated generally at 330. To use the second alternative mount plate 318, the key 330 is inserted into the lock 327, and the extension 324 is rotated relative to the base 322 about a lock axis 327*a*. The extension 324 is then retained relative to the base 322 and the assembled second alternative mount plate 318 may be used similar to the mount plate 18. The illustrated lock 327 includes an insertion opening 327*b* and a retaining surface 327*c*, while the illustrated key 330 includes a narrow 330*a* and an engagement end 330*b*. The insertion opening 327*b* is large enough to allow the engagement end 330 to pass therethrough while the retaining surface 327*c* is sized to engage the narrow 330*a* of the key 330. It should be appreciated that the base 322 may be anchored to the ground surface 18 prior to connecting the extension 324 to the base 322, if desired.

Figure 7:
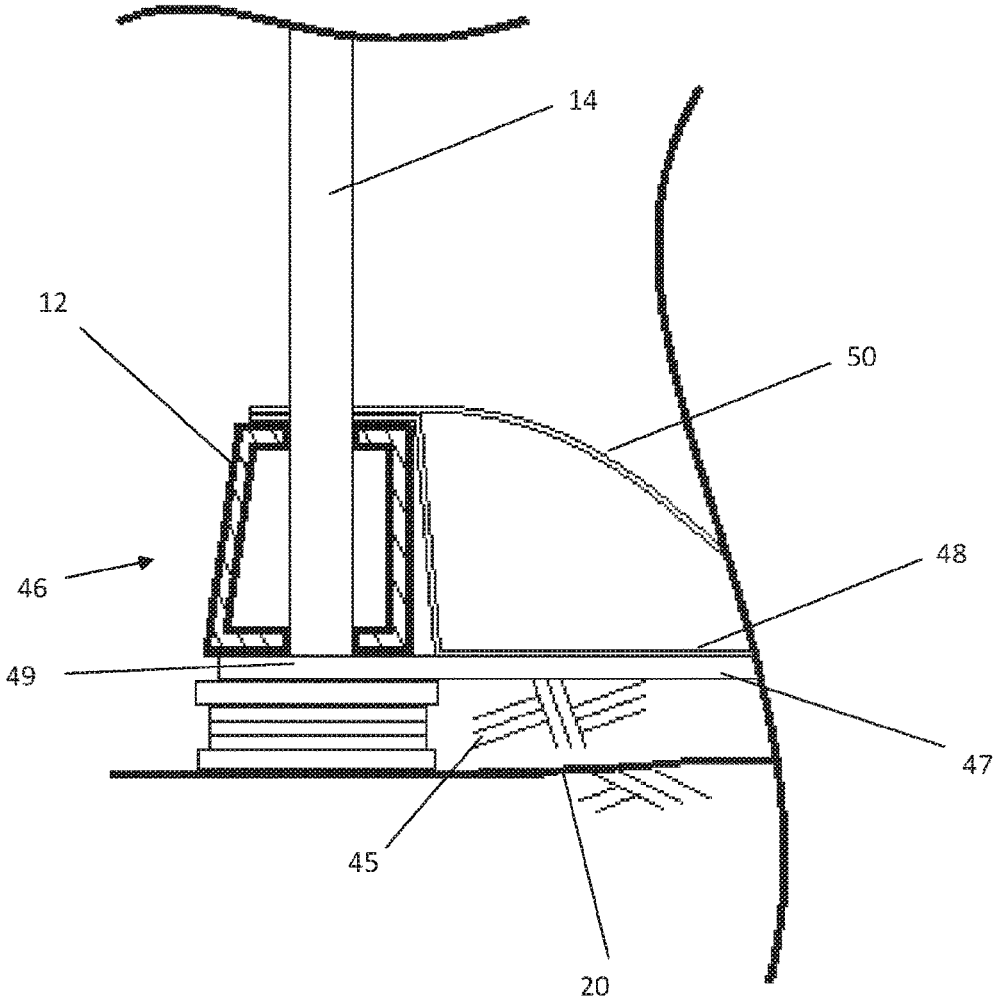
FIG. 7 is a cross-sectional view of a portion of a partially-constructed wall of the fabricated building.

Referring to FIG. 7, there is shown a cross-sectional view of a partially-assembled wall 16. Optional fill material 45 is shown placed over the ground surface 20 to adjust or level the surface. An optional sub-floor 47 is shown placed over the ground surface 20 or fill material 45. The sub-floor 47 serves to provide a relatively stable base for the interior of the fabricated building 10. The illustrated sub-floor 47 comprises multiple panels of corrugated polypropylene and define sub-floor guide holes 49 which are positioned over the guide poles 14. However, any desired material may be used.

A lowest layer, indicated at 46, of structural members 12 is shown installed on the guide poles 14. An optional floor 48 is installed over the sub-floor 47 and is draped over the lowest layer 46. The floor 48 serves to provide a barrier against water, insects, and contaminants. The illustrated floor 48 is made of a nylon mesh laminated with Teflon, although it may be made of other desired materials. It should be appreciated that the fill material 45 may be used to adjust the elevation and contours of the floor 48, if desired. Additionally, an optional wall cover 50 is also draped over the lowest layer 46. The wall cover 50 also serves to provide a barrier against water, insects, and contaminants, as well as to provide increased privacy for an occupant of the fabricated building 10, as will be described below. The illustrated wall cover 50 is made of a nylon mesh laminated with Teflon, although it may be made of other desired materials.

Figure 8:
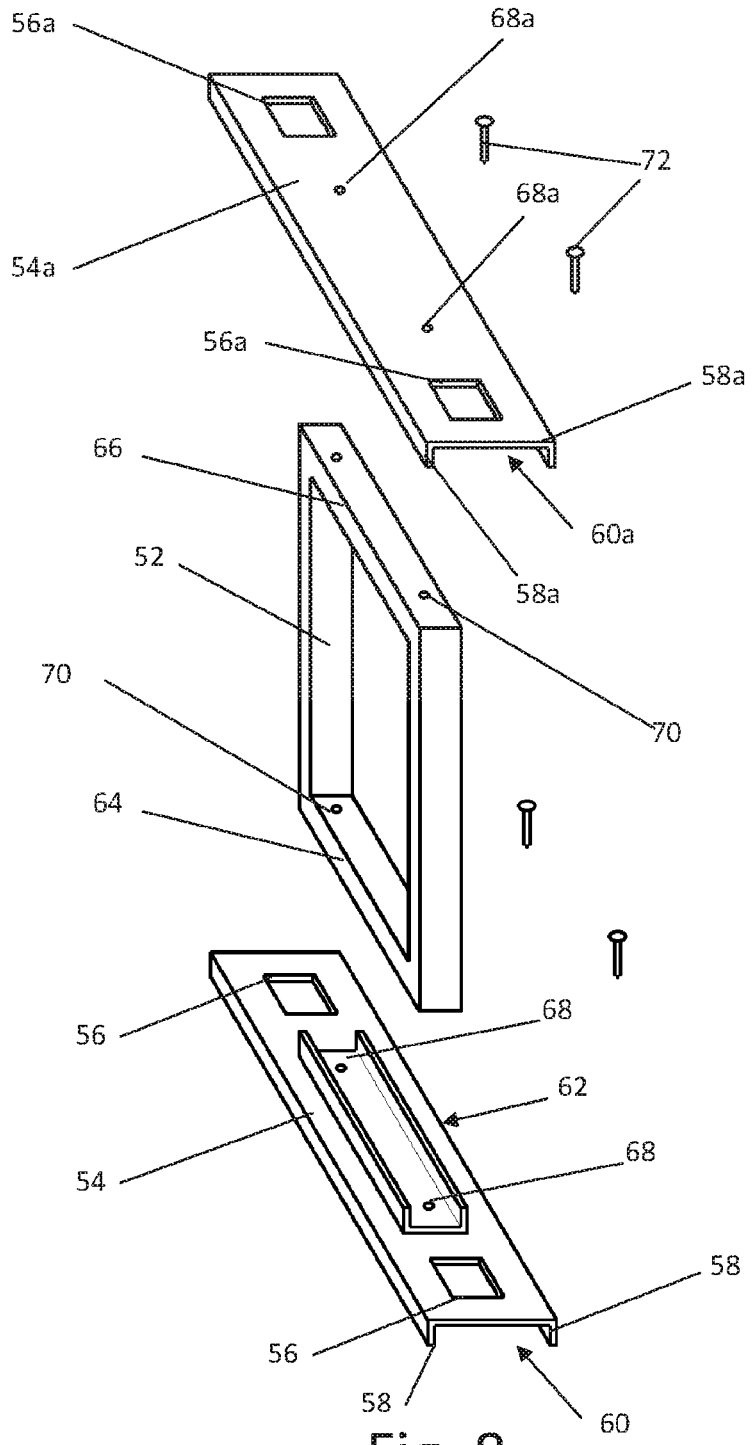
FIG. 8 is a perspective view of a window frame and thresholds for the fabricated building.

Referring to FIG. 8, a perspective view of a window frame 52 is shown. The illustrated window frame 52 is configured to be installed in one of the walls 16 by an illustrated first threshold 54 and second threshold 54*a*. The illustrated first threshold 54 and second threshold 54*a* are made of steel, although they may be made of any desired material.

Figure 9:
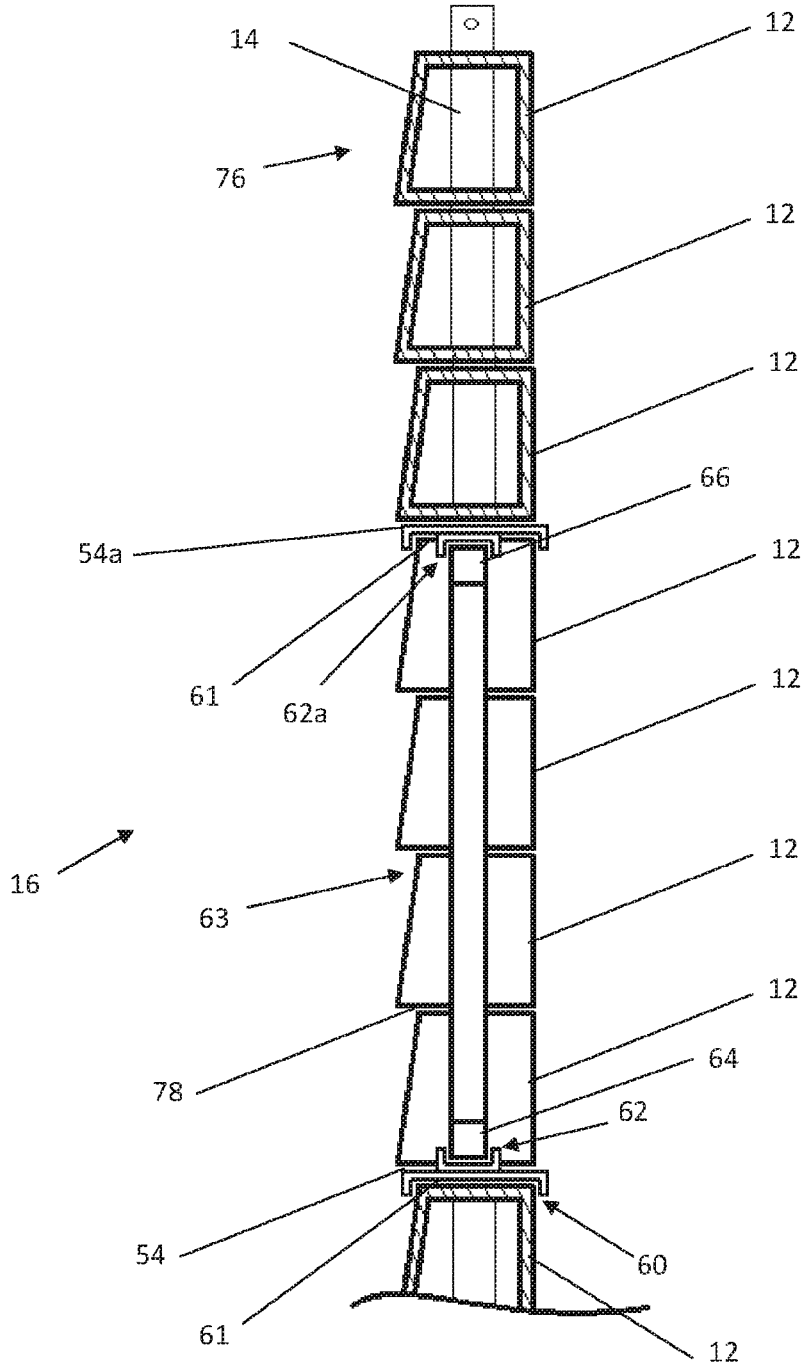
FIG. 9 is a cross-sectional view of the wall of the fabricated building with the window frame installed therein.

The first threshold 54 defines a plurality of threshold guide holes 56 that are positioned so that the first threshold 54 can be installed on the wall 16 the guide poles 14 pass through the threshold guide holes 56. The illustrated first threshold 54 includes side walls 58 that define a U-shaped wall channel, indicated at 60. The first threshold 54 is installed on the wall 16 with the wall channel 60 opening downwardly. As shown in FIG. 9, the wall channel 60 is wide enough to fit over a top surface 61 of structural member 12. The first threshold 54 includes a first frame channel, indicated at 62. The illustrated first frame channel 62 is a separate piece that is welded to the first threshold 54, but the first frame channel 62 may be an integral part of the first threshold 54, if desired. The first frame channel 62 defines a U-shaped channel that opens upwardly when the first threshold 54 is installed on the wall 16.

A desired number of additional layers of structural members 12 are installed on the guide poles 14 (in the illustrated embodiment, there are four additional layers) and then the second threshold 54*a* is installed. The second threshold 54*a* includes sidewalls 58*a* that define a second U-shaped wall channel 60*a*. The second threshold 54*a* is installed on the wall 16 with the wall channel 60*a* opening downwardly and the wall channel 60*a* is wide enough to fit over the top surface 61 of structural member 12.

The second threshold 54*a* includes a second frame channel, indicated at 62*a*. The illustrated second frame channel 62*a* is a separate piece that is welded to the second threshold 54*a*, but the second frame channel 62*a* may be an integral part of the second threshold 54*a*, if desired. The second frame channel 62*a* defines a U-shaped channel that opens downwardly when the second threshold 54*a* is installed on the wall 16. A frame space, indicated at 63, is defined in the wall 16 between the first frame channel 62 and the second frame channel 62*a*. The window frame 52 is installed in the frame space 63 with a first end 64 located in the first frame channel 62 and a second end 66 located in the second frame channel 62*a*.

It should be appreciated that the window frame 52 may include a glass or plastic window, as well as a screen, if desired. Additionally, it should be appreciated that the window frame 52 may be replaced with a frame for any desired opening in the wall 16, for example, a door, a plumbing opening, a vent. The size of the frame space 63 may be changed depending on the size of the frame to be installed. For example, a door will typically use a larger opening than a window. The illustrated fabricated building 10 includes both the window frame 52 and a door frame 74 (shown in FIG. 1). However, the fabricated building 10 may include any desired openings. The illustrated window frame 52 and door frame 74 are installed using similar first thresholds 54 and second thresholds 54*a*. It should be appreciated that additional, desired equipment may be installed in or around the window frame 52. For example, insulation could be installed to help prevent cold air from moving through the opening, or to help prevent a hot exhaust vent from damaging the structural members 12, or a drip plate could be installed to channel precipitation or other fluids out of the fabricated building 10.

As best seen in FIG. 8, the first threshold 54 defines optional threshold pin holes 68 while the window frame 52 defines optional window pin holes 70. The window pin holes 70 on the first end 64 of the window frame 52 are axially aligned with the threshold pin holes 68 and optional window pins 72 are inserted through the window pin holes 70 and the threshold pin holes 68. The illustrated window pins 72 are made of steel, but they may be made of any desired material. Similarly, the window pin holes 70 on the second end 66 of the window frame 52 are axially aligned with threshold pin holes 68*a* defined by the second threshold 54*a* and window pins 72 are inserted through the threshold pin holes 68*a* and the window pin holes 70. When the fabricated building 10 is assembled, the first threshold 54 and the second threshold 54*a* prevent movement of the window frame 52 vertically as well as inwardly or outwardly relative to the wall 16, while the structural members 12 prevent movement of the window frame 52 side-to-side relative to the wall 16.

Referring back to FIG. 9, additional layers of structural members 12 are installed on the guide poles 14 to complete the wall 16, including a highest layer, indicated at 76, of structural members 12. The optional wall cover 50 is draped over the highest layer 76. The illustrated wall cover 50 includes pre-cut openings to correspond to the location of the window frame 52 and door frame 74. Alternatively, the wall cover 50 may not include pre-cut openings, allowing the locations of the window frame 52 and door frame 74 to be selected during assembly of the fabricated building 10. The wall cover 50 provides a barrier to keep contaminants and light from passing through the wall 16 through any gaps 78 between the structural members 12.

Figure 10:
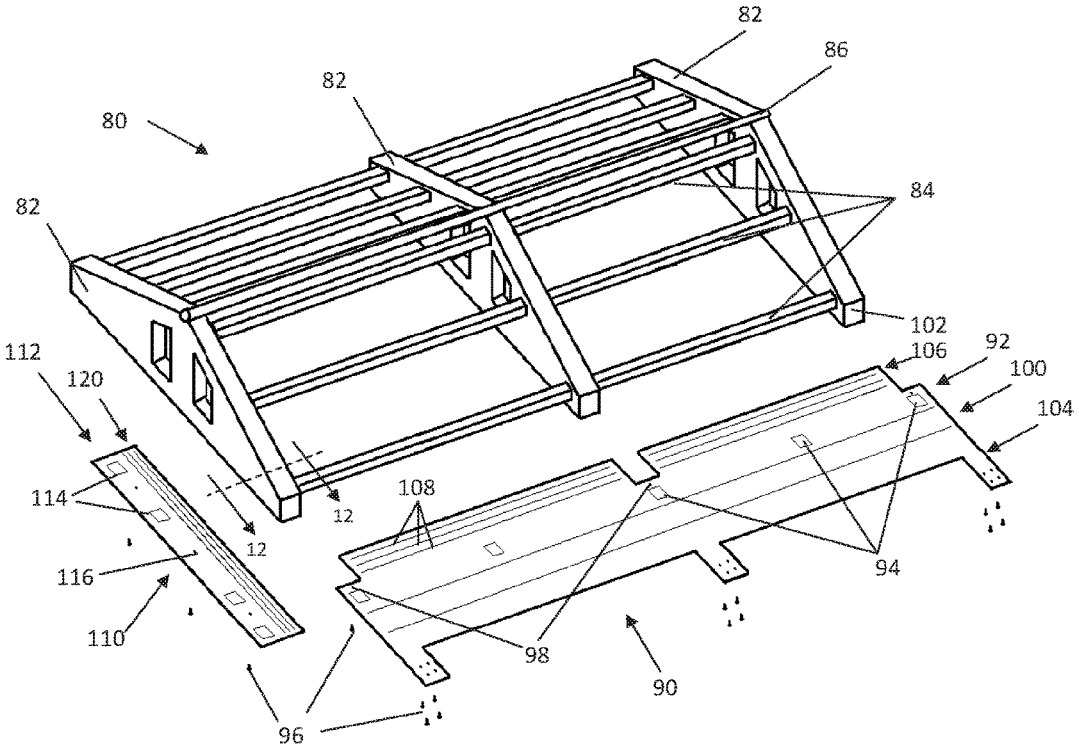
FIG. 10 is a perspective view of a partially-assembled roof frame.

Referring to FIG. 10, a perspective view of a partially-assembled roof frame, indicated at 80, is shown. The roof frame 80 includes trusses 82 and cross beams 84. The illustrated trusses 82 and cross beams 84 are made of folded corrugated polypropylene sheet material, but they may be made of any desired materials. A ridge pole 86 is supported on the trusses 82. The ridge pole 86 serves to support a roof 88, as will be described below. The ridge pole 86 also serves to help prevent movement of one of the trusses 82 relative to the other trusses 82 and helps prevent the walls 16 from moving relative to each other when the fabricated building 10 is assembled. The illustrated ridge pole 86 is a three-inch diameter PVC pole, but may be any desired support.

Figure 11:
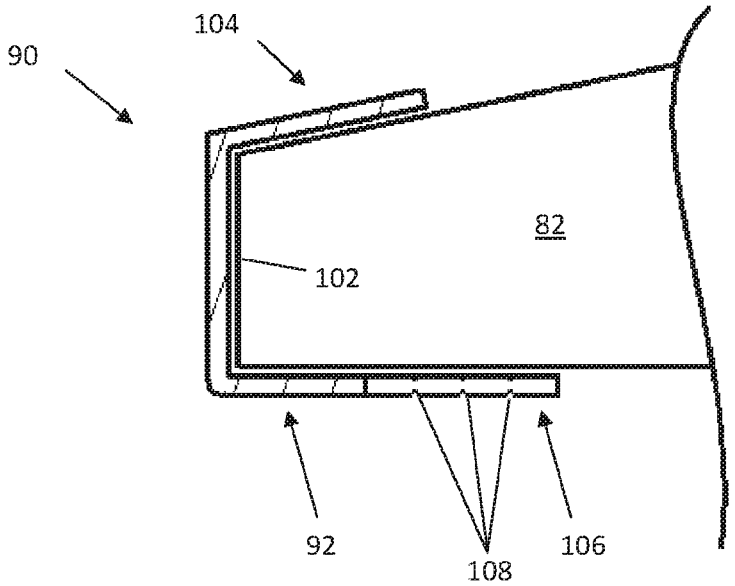
FIG. 11 is a cross-sectional view of a portion of the partially-assembled roof frame.

The roof frame 80 also includes a soffit member, indicated at 90. The soffit member 90 is shown before it is attached to the roof frame 80. The illustrated soffit member 90 is made of corrugated polypropylene, but may be made of any desired material. The soffit member 90 includes a lower portion, indicated at 92. The lower portion 92 defines soffit guide holes 94 that are positioned to fit over the guide poles 14. The soffit member 90 is connected to the trusses 82 by connectors 96 that pass through first connector holes 98 defined in the lower portion 92. The illustrated connectors 96 are plastic bolts, but any desired connector may be used to connect the soffit member 90 to the trusses 82. The soffit member 90 also includes an outer portion, indicated at 100, connected to the lower portion 92. When the soffit member 90 is attached to the roof frame 80, the outer portion 100 is folded up to cover outer ends 102 of the trusses 82. Referring to FIG. 11, a cross-sectional view of the roof frame 80 is shown, with the soffit member 90 attached to the roof frame 80. The soffit member 90 also includes an upper portion, indicated at 104, connected to the outer portion 100. The upper portion 104 is folded on top of the trusses 82 and is connected to the trusses 82 by additional connectors 96. The soffit member 90 also includes a roll-up portion, indicated at 106, that is connected to the lower portion 92. The roll-up portion 106 includes a plurality of fold lines 108, the purpose of which will be described below.

Figure 12:
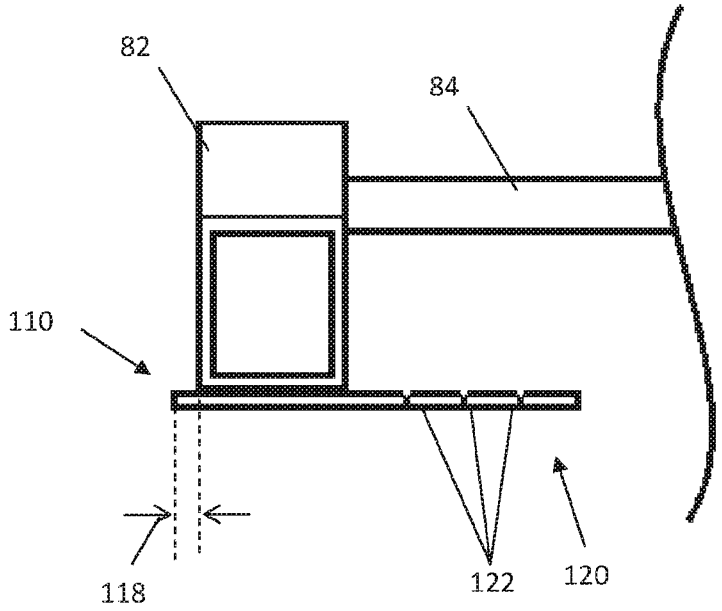
FIG. 12 is a cross-sectional view of a different portion of the partially-assembled roof frame.

Referring back to FIG. 10, the roof frame 80 also includes a truss roll-up, indicated at 110. The truss roll-up 110 is shown before it is attached to the roof frame 80. The illustrated truss roll-up 110 is made of corrugated polypropylene, but may be made of any desired material. The truss roll-up 110 includes an attachment portion, indicated at 112. The attachment portion 112 defines roll-up guide holes 114 that are positioned to fit over the guide poles 14. The truss roll-up 110 is connected to one of the outer trusses 82 by additional connectors 96 that pass through connector holes 116 defined in the attachment portion 112. Referring to FIG. 12, a cross-sectional view taken along line 12-12 of FIG. 10 is shown, with the truss roll-up 110 attached to the truss 82. As shown, the truss roll-up 110 extends an overhang distance 118 beyond the truss 82. The purpose of the overhang distance 118 is to help keep water that runs off the roof 88 away from the wall 16 of the assembled fabricated building. The truss roll-up 110 includes a roll-up portion, indicated at 120 that is connected to the attachment portion 112. The roll-up portion 120 includes a plurality of fold lines 122, the purpose of which will be described below.

Figure 13:
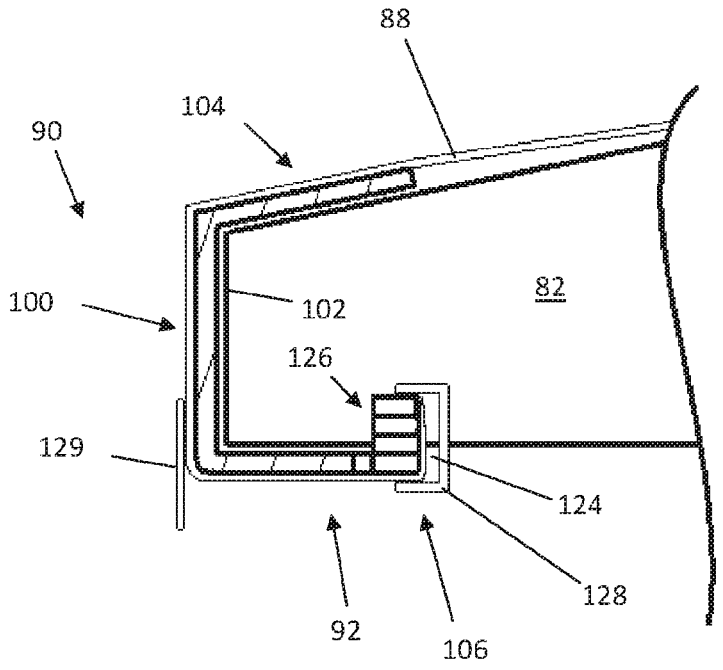
FIG. 13 is a cross-sectional view similar to that of FIG. 12, with a roof connected to the roof frame.

For clarity, only one soffit member 90 is shown in FIG. 10, but it should be appreciated that the illustrated fabricated building includes a second soffit member on the opposite side of the roof frame 80. Similarly, although only one truss roll-up 110 is shown, it should be appreciated that the illustrated fabricated building includes a second truss roll-up on the opposite side of the roof frame 80. With the roof frame 80 assembled the roof 88 is then placed over the roof frame 80. The illustrated roof 88 is made of a nylon mesh laminated with Teflon, although it may be made of other desired materials. The roof 88 is large enough to overhang the roof frame 80, and is attached to the roof frame 80 by the roll up portion 106 and 120 of the soffit member 90 and the truss role-up 110, respectively. Referring back to FIG. 11, the roll up portion 106 soffit member 90 is located below the trusses 82. Referring now to FIG. 13, the roof 88 is placed above the trusses 82 and is folded below the trusses 82 and an outer edge 124 of the roof 88 is placed adjacent to the roll up portion 106. The roll up portion 106 is then folded at the fold line 108, along with the outer edge 124 of the roof 88. It should be appreciated that this traps the inner edge 124 between overlapping layers of the roll up portion 106 in a roof lock, indicated at 126. One or more clips 128 may be used to prevent the roll up portion 106 from unfolding. The illustrated clip 128 is made of steel, but the clips may be made of any desired materials. The roof 88 is shown with an optional drip edge 129 installed. The illustrated drip edge 129 is a section of nylon mesh laminated with Teflon approximately three inches wide, and extends around the entire roof. However, the drip edge 129 may be made of any desired material. The illustrated drip edge 129 is welded to the roof 88, but may be connected to the roof 88 in any desired manner. When the roof 88 is installed, the drip edge 129 extends from the roof 88 and hangs below the lower portion 92 of the soffit member 90. The drip edge 129 is provided to help guide precipitation from the roof 88 onto the outer surface of the wall 16.

Figure 14:
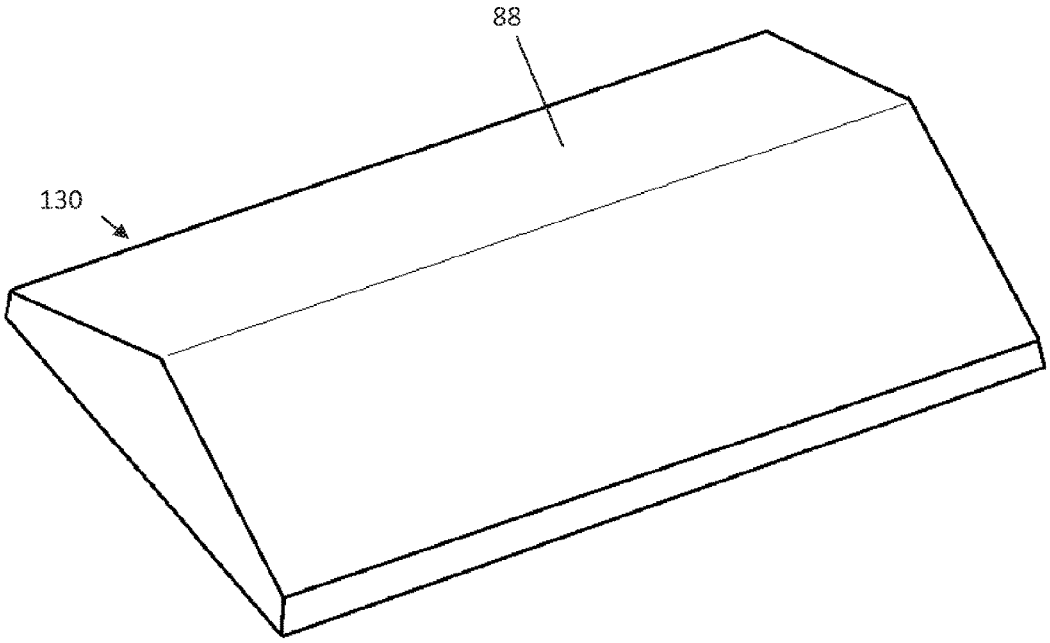
FIG. 14 is a perspective view of the assembled roof frame.

It should be appreciated that the roll up portion 120 of the truss roll-up 110 (shown in FIG. 12) engages and locks an edge of the roof 88 in a similar manner. Consequently, when the roof frame 80 and roof 88 are fully assembled, all edges of the roof 88 are engaged and restrained to the roof frame 80. Referring to FIG. 14, a perspective view of a roof assembly, indicated at 130, including the roof frame 80 with the roof 88 attached, is shown. It should be appreciated that the illustrated roof assembly 130 is self-supporting, and may be assembled as shown, without being attached to the walls 16. Referring back to FIG. 1, the roof assembly 130 is installed on top of the walls 16, above the highest layer 76 of structural members 12.

It should be appreciated that both the walls 16 of the fabricated building 10 and the roof assembly 130 have some play in their assembled shape. That is, one or both of the assemblies may not be perfect squared. However, the play in one assembly allows it to be adjusted to fit onto the other assembly during mating.

Figure 15:
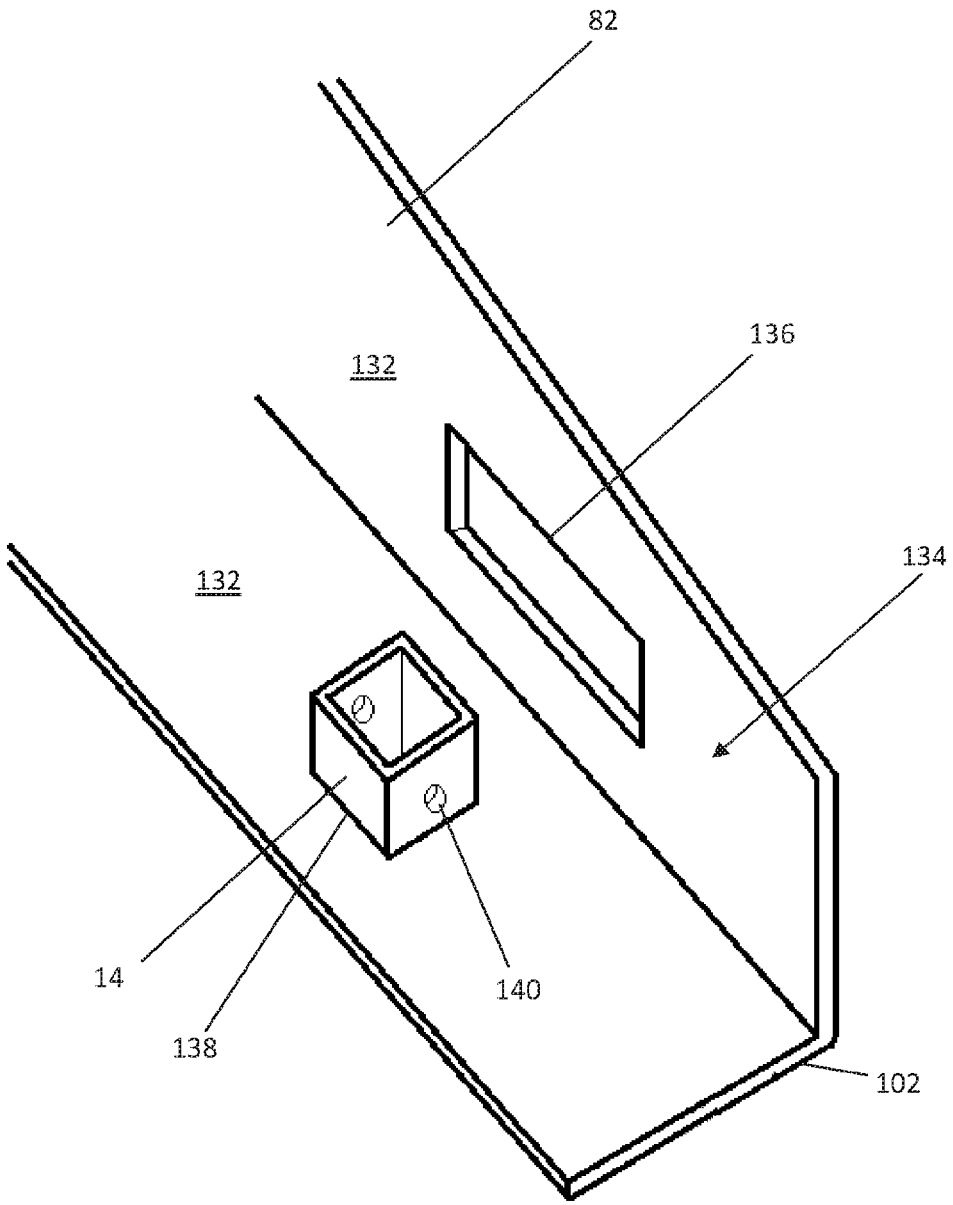
FIG. 15 is a partially cut-away perspective view of a truss for the roof frame when placed on the fabricated building.

Referring to FIG. 15, a partially-cut away view of one of the trusses 82 is shown. An interior wall 132 of the truss 82 is shown. Only two sides of the truss 82 are shown, and it should be appreciated that the other walls are not shown for clarity. The truss 82 defines an interior space, indicated at 134, and an opening 136 in the truss 82 provides access to the interior space 134. When the roof assembly 130 is placed on the walls 16, one of the guide poles 14 extends through a truss guide hole 138 and into the interior space 134. An upper pole hole 140 is defined by the guide pole 14, and is positioned in the interior space 134. It should be appreciated that the guide pole 14 is initially sitting on the base platform 34 of the mount plate 18 and the number of layers of structural members 12 in the wall 16 is known and as a result it is known in advance that the upper pole hole 140 will be located within the interior space 134 of the truss 82.

Figure 16:
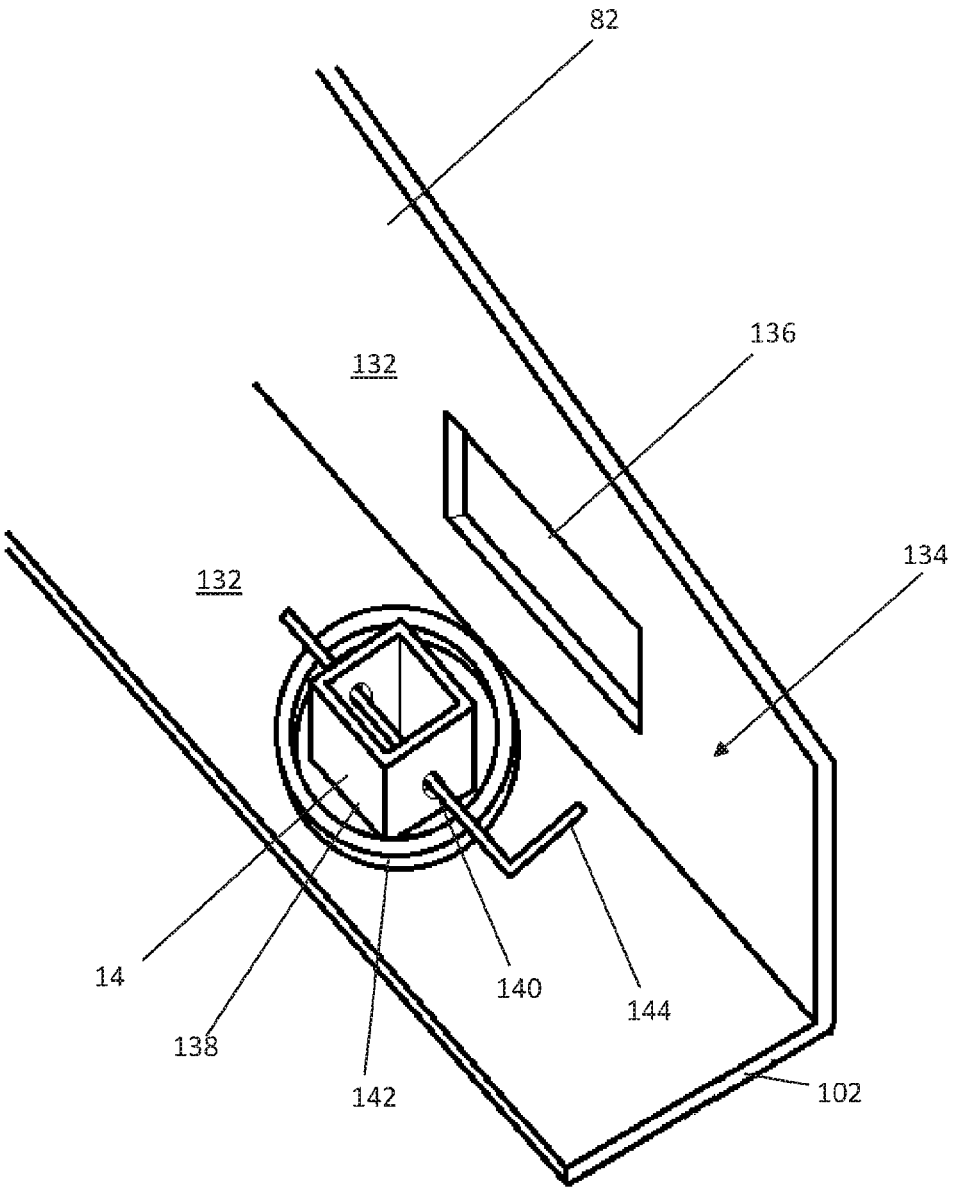
FIG. 16 is a view similar to that of FIG. 15, showing a plate and upper fastener used to anchor the truss to a guide pole.

Referring to FIG. 16, a plate 142 is placed in the interior space 134 and around the guide pole 14. An upper fastener 144 is inserted through the upper pole hole 140, trapping the plate 142 between the interior wall 132 of the truss and the upper fastener 144. The illustrated plate 142 is a steel ring, while the illustrated upper fastener 144 is a steel pin, but these may be made of any desired materials. It should be appreciate that similar connections are installed at the upper end of each guide pole 14 that enters a truss 82. The plate 142 and upper fastener 144 cooperate to prevent the truss 82 from moving relative to the guide pole 14. Additionally, as previously described (and shown in FIG. 6), the lower fastener 44 prevents the guide pole 14 from moving relative to the mount plate 18. Also, the ground anchors 28 prevent the mount plate 18 from moving relative to the ground surface 20. As a result, all the components of the assembled fabricated building 10 are anchored relative to the ground surface 20.

Figure 17:
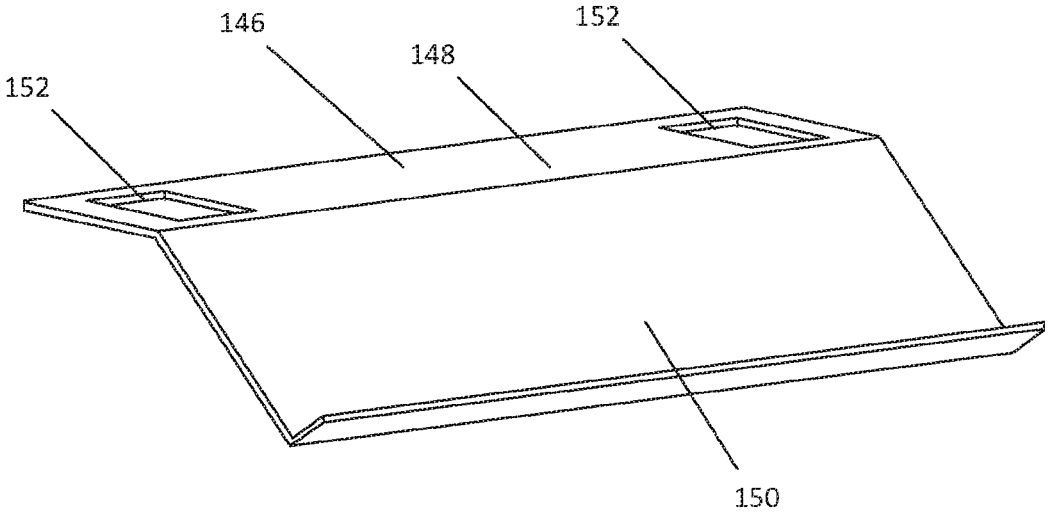
FIG. 17 is a perspective view of an optional window guard.
Figure 18:
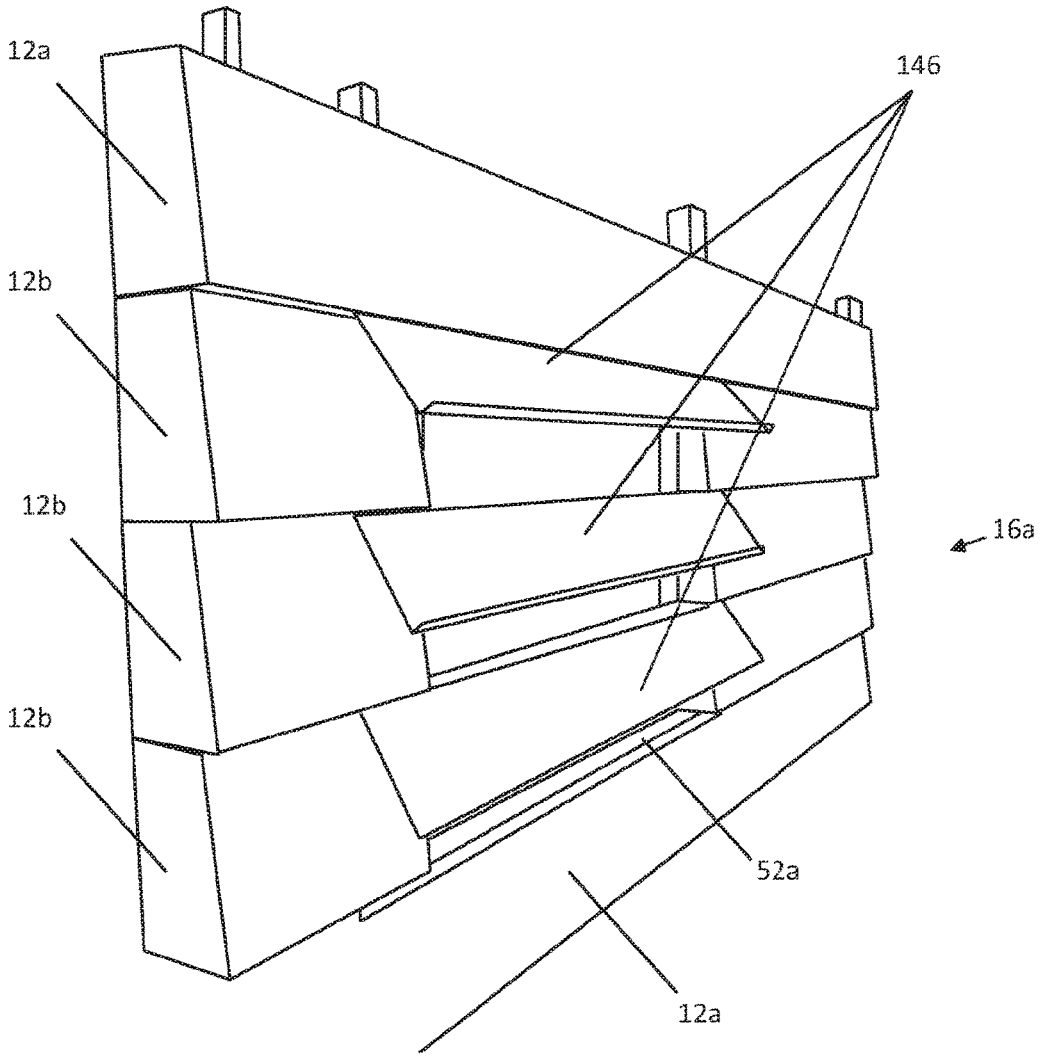
FIG. 18 is a perspective view of a portion of an alternative fabricated building, with the window guard installed.

Referring now to FIG. 17, a perspective view of an optional window guard 146 is shown. The illustrated window guard 146 is made of a single piece of transparent polycarbonate, but may be made of any desired material. The window guard 146 includes a positioning wing 148 extending from a guard body 150. The positioning wing 148 is positioned at approximately a 45-degree angle relative to the guard body 150. However, the positioning wing 148 may have any desired orientation relative to the guard body 150. The positioning wing 148 includes two positioning holes 152. Referring to FIG. 18, a perspective view of a portion of an alternative wall 16*a* is shown with a plurality of the window guards 146 installed. As shown, the wall 16*a* is made from a plurality of structural members 12*a*, which are similar to the structural members 12, and structural members 12*b*, which have a shorter length than the structural members 12 but are otherwise similar. The structural members 12*b* are used to define a space for a window frame 52*a*. As shown, a plurality of window guards 146 are installed during assembly of the wall 16*a* by positioning the positioning wings 148 so that the guide poles 14*a* pass through the positioning holes 152 while the guard body 150 is located on the outside of the wall 16*a*. It should be appreciated that the window guards 146 may be installed after the wall 16*a* is assembled if, for example, the positioning holes 152 have an open U-shape that allows them to be slid around the guide poles 14*a* of the assembled wall 16*a*. When installed, the window guards 146 help prevent rain outside the alternative fabricated building 10*a* from getting in through the window frame 52*a* while still allowing air and light to pass through. It should be appreciated that the window guards 146 may be made of a translucent or opaque material, in order to increase the privacy of the interior space of the alternative fabricated building 10*a*, if desired.

Figure 19:
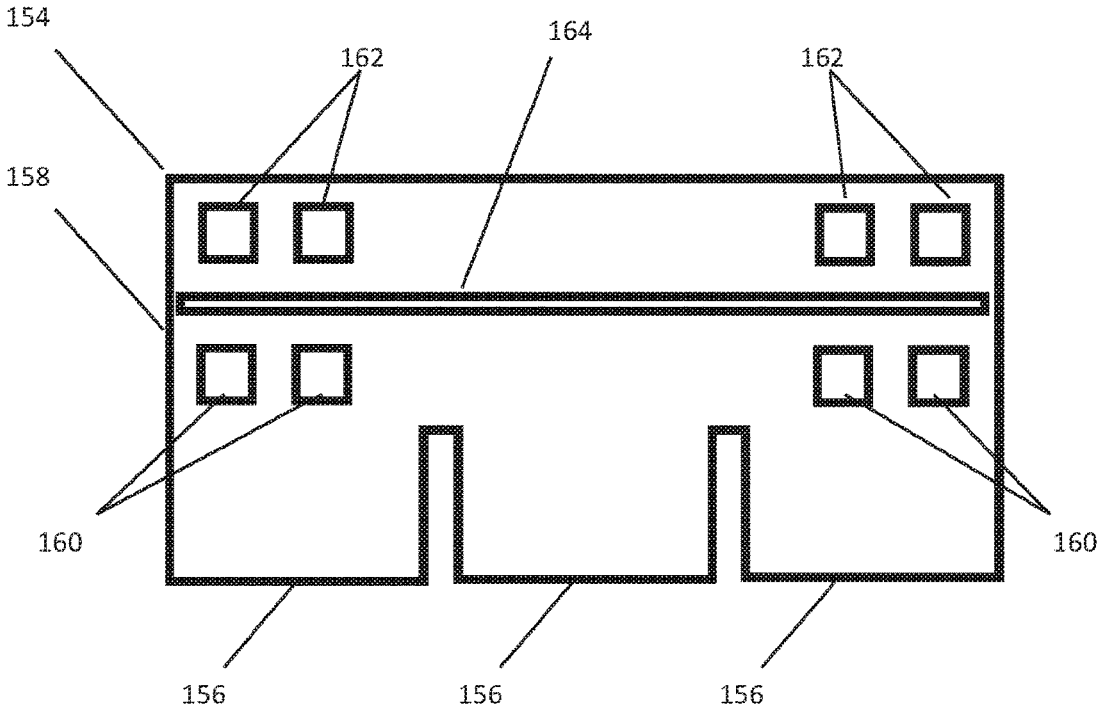
FIG. 19 is an overhead, plan view of an optional roof skirt.

Referring now to FIG. 19 through FIG. 23, an alternative roof design is illustrated. This alternative roof design is illustrated as being installed on the fabricated building 10 in place of the roof 88. Referring to FIG. 19, an overhead, plan view of a roof skirt 154 is shown. The illustrated roof skirt 154 is a single piece of nylon mesh laminated with Teflon, but it may be made in multiple pieces and may be made of any desired material. The roof skirt 154 includes a plurality of skirt tongues 156 that extend from a skirt fold-over 158. The illustrated roof skirt 154 includes three skirt tongues 156, but it may include any desired number of skirt tongues 156. The illustrated skirt fold-over 158 is long enough to span the distance between two of the guide poles 14, and the skirt fold-over 158 includes a plurality of first skirt guide holes 160 and second skirt guide holes 162 that allow the roof skirt 154 to be positioned on one of the walls 16 with the guide poles 14 passing through the first skirt guide holes 160 and the second skirt guide holes 162, as will be described below. An optional skirt lock 164 is provided with the roof skirt 154, and the use of the skirt lock 164 will also be described below. The illustrated skirt lock 164 is a one-inch diameter piece of PVC pipe that is approximately the same length as the roof skirt 154, but may be any desired material and length.

Figure 20:
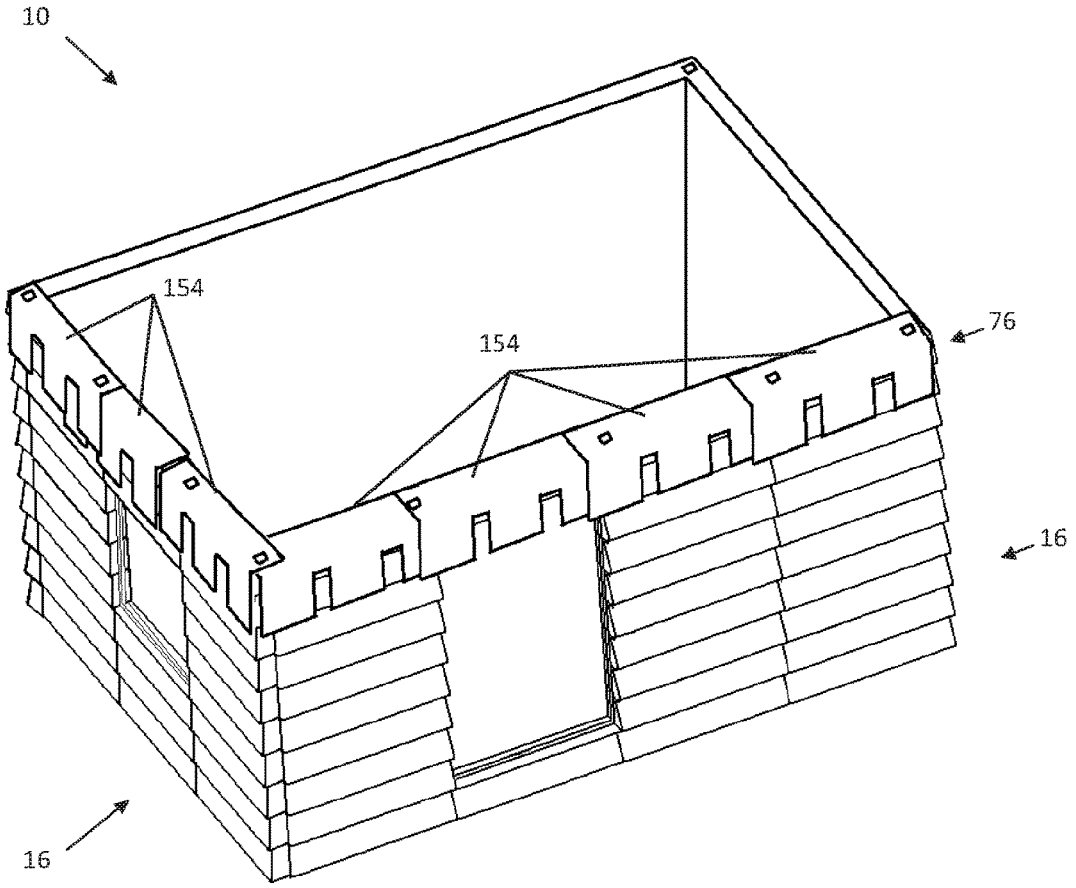
FIG. 20 is a perspective view of the partially-assembled fabricated building shown in FIG. 1, with a plurality of roof skirts installed.

Referring now to FIG. 20, a perspective view of the fabricated building 10, partially assembled, is shown. As shown in FIG. 20, the walls 16 are assembled but the roof frame 80 has not been connected. Additionally, a plurality of roof skirts 154 have been placed on the walls 16 above the highest layer 76 of structural members 12. Each roof skirt 154 is installed with its respective skirt tongues 156 located on the exterior side of the wall 16. The skirt fold-over 158 is positioned on top of the structural members 12, with guide poles 14 passing through at least some of the first skirt guide holes 160. The skirt lock 164 is positioned on top of the skirt fold-over 158, and the skirt fold-over 158 is then folded over so that the guide poles 14 also pass through at least some of the second skirt guide holes 162. As shown, the skirt lock 164 is located on an interior side of the wall 16, and is supported by the roof skirt 154. It should be appreciated that the order of installing the roof skirt 154 may be reversed, if desired. Preferably, each roof skirt 154 is installed so that it engages at least two of the guide poles 14, but this is not necessary. Additionally, it should be appreciated that multiple roof skirts 154 may engage a single guide pole 14, but this is also not necessary. It is possible that the skirt tongues 156 of adjacent roof skirts 154 may overlap each other. Additionally, all of the skirt tongues 156 may be located on a single roof skirt 154, or multiple wall-length roof skirts 154 may be used in assembly of the fabricated building 10. In FIG. 20, roof skirts 154 are only illustrated on two of the walls 16, but it should be appreciated that during typical assembly roof skirts 154 will be placed on all walls 16.

Figure 21:
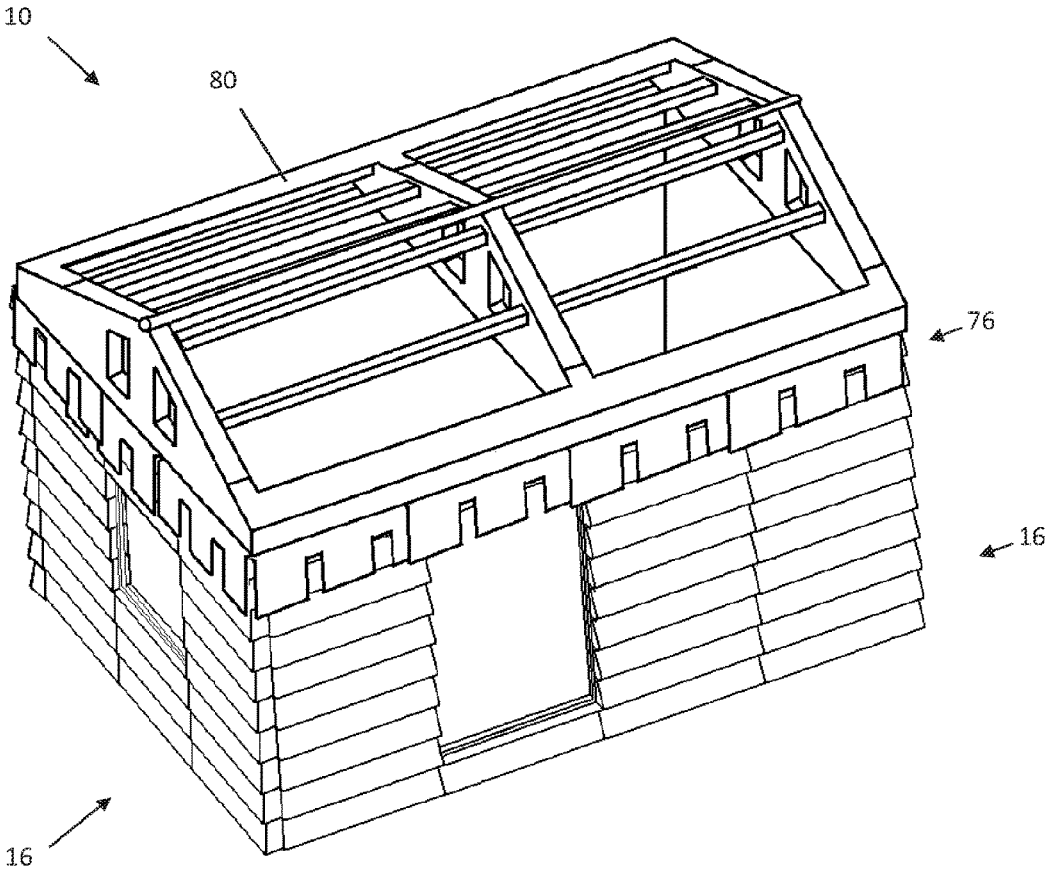
FIG. 21 is a perspective view similar to that shown in FIG. 20, with the roof frame installed over the plurality of roof skirts.
Figure 24:
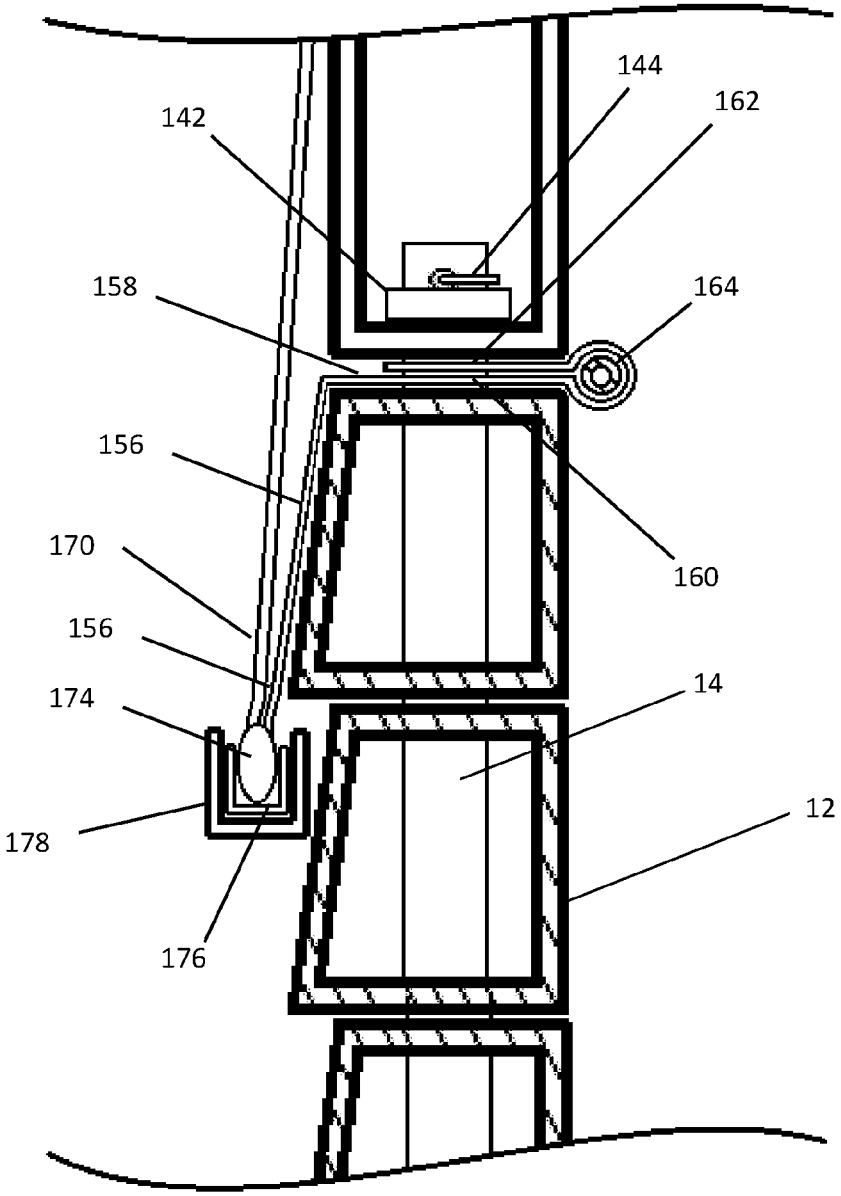
FIG. 24 is a cross-sectional view of a portion of the fabricated building that includes the roll up roof installed thereon.

As shown in FIG. 21, the roof frame 80 is then placed on top of the walls 16. It should be appreciated that the skirt fold-over 158 of the roof skirts 154 are trapped between the walls 16 and the roof frame 80. This is best seen in FIG. 24. The roof fame 80 may then be connected to the guide poles 14, as previously described in reference to FIG. 15 and FIG. 16. It should be appreciated that while the roof skirts 154 are shown as located between the walls 16 and the roof frame 80, they may alternatively be located between two layers of the structural members 12 that comprise the wall 16, if desired. Additionally, the roof skirts 154 may optionally be welded or otherwise connected to the wall 16, if desired.

Figure 22:
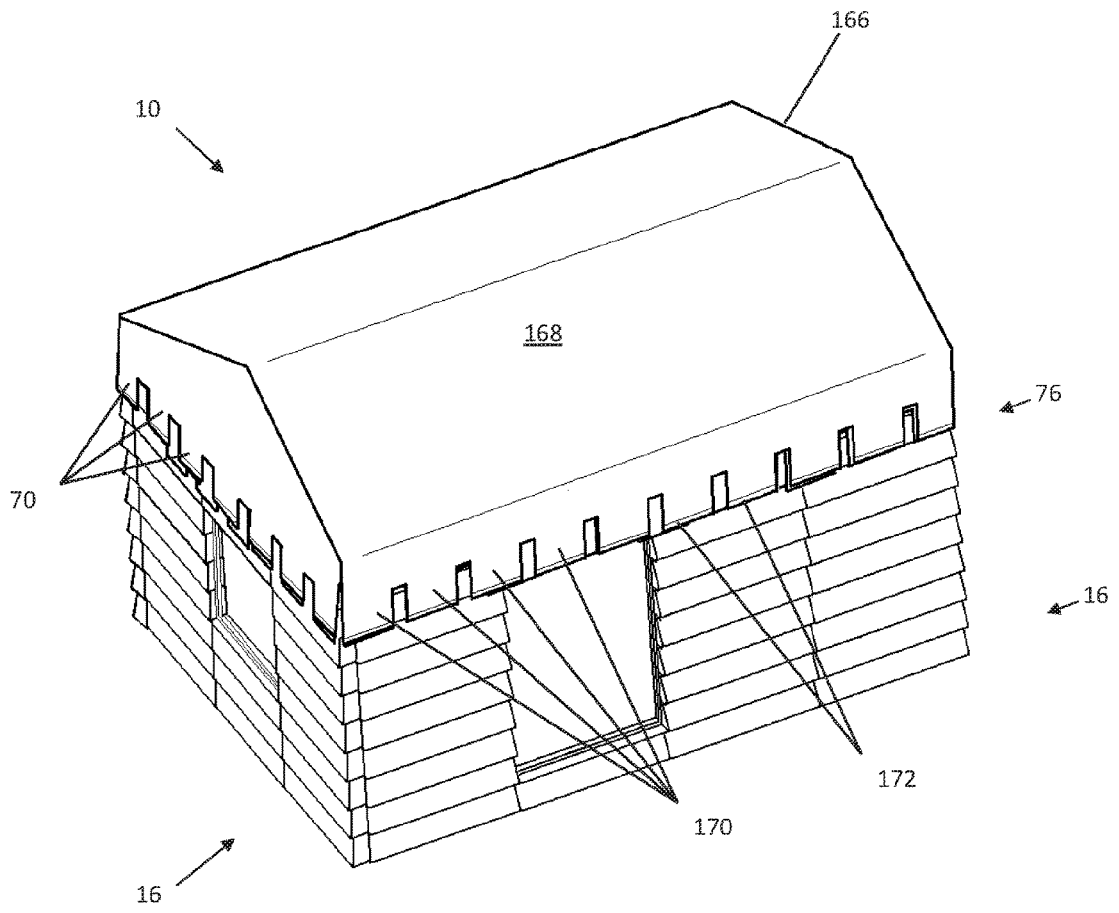
FIG. 22 is a perspective view similar to that shown in FIG. 21, with a roll up roof shown partially installed.

Referring now to FIG. 22, a roll-up roof 166 is illustrated positioned above the roof frame 80. The illustrated roll-up roof 166 is made of a single piece of nylon mesh laminated with Teflon, but it may be made in multiple pieces and may be made of any desired material. The roll-up roof 166 includes a cover section 168 that is dimensioned to fit over and conform to the shape of the roof frame 80. The roll-up roof 166 also includes a plurality of roof tongues 170 that extend from the cover section 168. When the roll-up roof 166 is positioned over the roof frame 80, as shown in FIG. 22, the roof tongues 170 are generally adjacent to the skirt tongues 156. The roll-up roof 166 may include a number of roof tongues 170 that is equal to the total number of skirt tongue 156, if desired. Alternatively, the roll-up roof 166 may include a different number of tongues 170. It should be appreciated that when the roll-up roof 166 is positioned on roof frame 80, the roof tongues 170 do not necessarily have to be precisely positioned next to the skirt tongues 156, and there may be some room for adjustment or play in the position of the cover section 168.

It should be appreciated that the illustrated roll-up roof 166 is custom sized to cover the roof frame 80 of the illustrated fabricated building 10, but this is not necessary. Additionally, the roll-up roof 166 may be configured so that each roof tongue 170 is substantially adjacent to one skirt tongue 156 when the roll-up roof 166 is positioned on the roof frame 80, but this is not necessary. The roll-up roof 166 may include a number of roof tongues 170 that is different from the number of skirt tongues 156 if desired, and each of the skirt tongues 156 does not need to be generally adjacent to one of the roof tongues 170. Each of the roof tongues 170 includes an optional tongue strip 172. Each illustrated tongue strip 172 is a two-sided plastic clip that is slipped onto the roof tongue 170. However, the tongue strip 172 may be made of any desired material and does not need to be connected to the roof tongue 170. The tongue strip 172 is a spool that one or more skirt tongue 156 and one or more roof tongue 170 are rolled up together on. In order to connect the illustrated roll-up roof 166 to the fabricated building 10, the skirt tongues 156 and one roof tongues 170 are folded together around the tongue strips 172 to form a plurality of roof locks 174, which is shown schematically in FIG. 24. It should be appreciated that a roof lock 174 may be created by folding one skirt tongue 156 and one roof tongue 170 around one tongue strip 172, or by folding a different desired number of skirt tongues 156 and roof tongues 170 together. A roof clamp 176 is applied to prevent the roof lock 174 from unfolding. It should be appreciated that the tongue strip 172 provides a spool to fold the roof lock 174 onto, and for the roof clamp 176 to engage to help prevent the roof lock 174 from pulling loose. The illustrated roof clamp 176 is a metal clip, but any desired connector may be used, including adhesives or welding. It should be appreciated that during installation of the roll-up roof 166, all of the skirt tongues 156 and all the roof tongues 170 will typically be assembled into roof locks 174. This will result in the roll-up roof 166 being anchored to the walls 16 of the fabricated building 10 around the whole perimeter of the roll-up roof 166.

Figure 23:
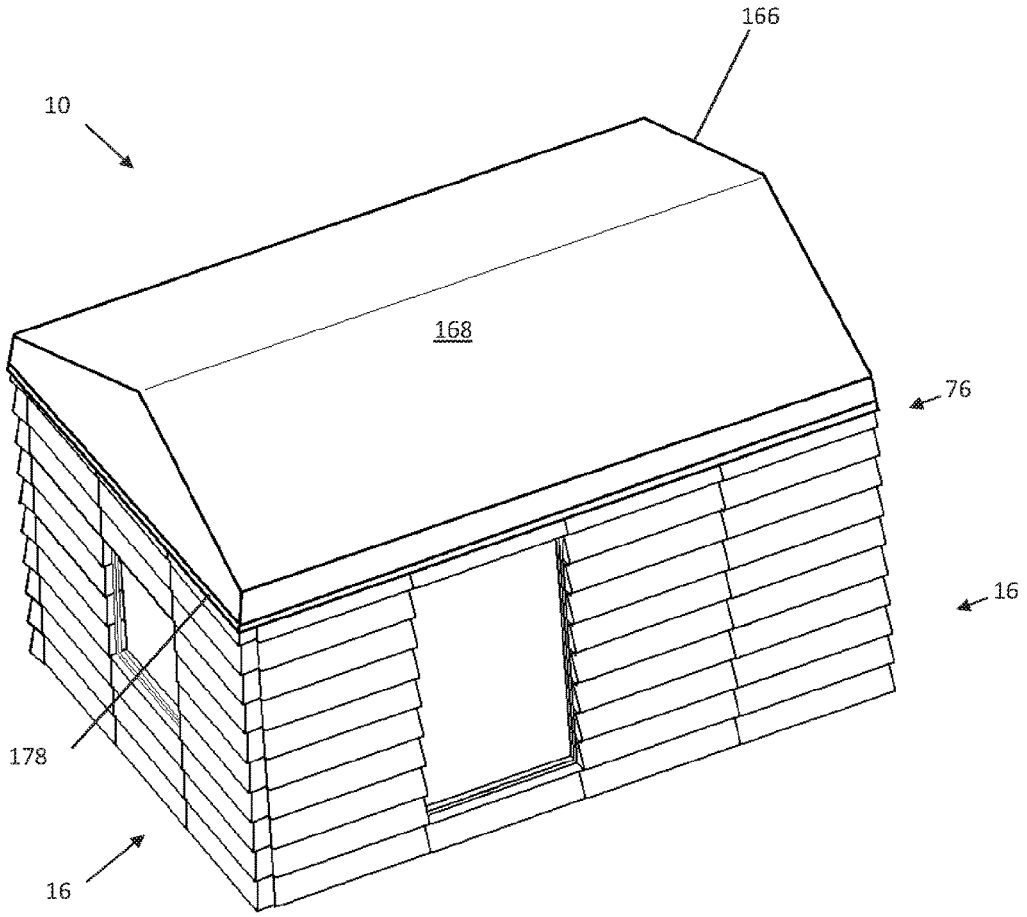
FIG. 23 is a perspective view similar to that shown in FIG. 22, showing the roll up roof fully installed.

Referring now to FIG. 23, the roll-up roof 166 is shown with a lock cover 178 installed. The illustrated lock cover 178 is made of a generally keystone-shaped piece of plastic, but any desired material or construction may be used. The lock cover 178 helps prevent the roof locks 174 from unfolding. The lock cover 178 is positioned to surround two or more adjacent roof locks 174. The illustrated lock cover 178 is also positioned below the top surface of the highest layer 76 of structural members 12.

It should be appreciated that the connection of the roll-up roof 166 does not include the use of the roll-up portion 106 of the soffit member 90, nor the roll-up portion 120 of the truss roll-up 110. Thus, the components may be omitted from the roof frame 80 when the roll-up roof 166 is used, if desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A fabricated building comprising:

a wall structure defining an interior side and an exterior side;

a roof frame supported on the wall structure;

a roof skirt supported by the wall structure and including a skirt tongue with a leading edge located on the exterior side of the wall structure;

a roll up roof supported by the roof frame and including a roof tongue with a leading edge located on the exterior side of the wall structure; and a roof lock that retains the roll up roof on the wall structure that is formed from the leading edge of the skirt tongue folded with the leading edge of the roof tongue.

2. The fabricated building of claim 1, further comprising a plurality of skirt tongues located on the exterior side of the wall structure;

a plurality of roof tongues located on the exterior side of the wall structure; and a plurality of roof locks that are formed from respective skirt tongues folded with respective roof tongues.

3. The fabricated building of claim 1, wherein the roof skirt includes a skirt fold-over that is located between the wall structure and the roof frame, and the skirt tongue extends from the skirt fold-over.

4. The fabricated building of claim 3, wherein the wall structure includes a plurality of vertically extending guide members arranged in a horizontally spaced apart relationship; and the skirt fold-over includes a first skirt guide hole that one of the vertically extending guide members passes through and a second skirt guide hole that the same one of the vertically extending guide members passes through.

5. The fabricated building of claim 3, wherein the wall structure includes a plurality of vertically extending guide members arranged in a horizontally spaced apart relationship; and the skirt fold-over includes a plurality of first skirt guide holes and a plurality of second skirt guide holes, and the skirt fold-over positioned so that a first of the vertically extending guide poles passes through one of the first skirt guide holes and one of the second skirt guide holes.

6. The fabricated building of claim 5, wherein the skirt fold-over is positioned so that a second of the vertically extending guide poles passes through at another one of the first skirt guide holes and another one of the second skirt guide holes.

7. The fabricated building of claim 6, further comprising an elongated skirt lock that is located on the interior side of the wall structure, extends generally perpendicularly to the vertically extending guide poles, and is supported by the roof skirt.

8. A fabricated building comprising:

a wall structure including a plurality of vertically extending guide members arranged in a horizontally spaced apart relationship and defining an interior side and an exterior side;

a roof frame supported on the wall structure;

a plurality of roof skirts supported by the wall structure, including a plurality of skirt fold-overs that are located between the wall structure and the roof frame, the skirt fold-overs including a plurality of first skirt guide holes and a plurality of second skirt guide holes, the skirt fold-over positioned so that a first of the vertically extending guide poles passes through one of the first skirt guide holes and one of the second skirt guide holes, each roof skirt including a skirt tongue with a leading edge that extends from the skirt fold-over and is located on the exterior side of the wall structure;

a roll up roof supported by the roof frame and including a roof tongue with a leading edge located on the exterior side of the wall structure; and a roof lock that is formed from the leading edge of the skirt tongue folded together with the leading edge of the roof tongue.

9. The fabricated building of claim 8, wherein the skirt fold-over is positioned so that a second of the vertically extending guide poles passes through at another one of the first skirt guide holes and another one of the second skirt guide holes.

10. The fabricated building of claim 9, further comprising an elongated skirt lock that is located on the interior side of the wall structure, extends generally perpendicularly to the vertically extending guide poles, and is supported by the roof skirt.

11. The fabricated building of claim 1, further comprising a tongue strip wherein the skirt tongue is folded with the roof tongue around the tongue strip.

12. The fabricated building of claim 1, further comprising a roof clamp that is applied to the roof lock to prevent the roof lock from unfolding.

13. The fabricated building of claim 1, further comprising a plurality of roof clamps that are applied to the roof lock to prevent the roof lock from unfolding and a lock cover that surrounds two or more of the plurality of roof clamps.

14. The fabricated building of claim 4, further comprising a first threshold defining a first guide hole having a first one of the guide members extending therethrough and a second guide hole having a second one of the guide members extending therethrough; and a second threshold defining a first guide hole having the first one of the guide members extending therethrough and a second guide hole having the second one of the guide members extending therethrough, the first threshold and the second threshold defining a frame space therebetween.

15. The fabricated building of claim 14, further comprising a frame disposed in the frame space and attached to the first threshold and the second threshold.

* * * * *